US011821245B2

(12) United States Patent
Herdering et al.

(10) Patent No.: US 11,821,245 B2
(45) Date of Patent: Nov. 21, 2023

(54) DOOR HANDLE ARRANGEMENT AND VEHICLE DOOR

(71) Applicant: Witte Automotive GmbH, Velbert (DE)

(72) Inventors: Markus Herdering, Bochum (DE); Zdenek Slovan, Plzen 1-Severni Predmesti (CZ)

(73) Assignee: Witte Automotive GmbH, Velbert (DE)

( * ) Notice: Subject to any disclaimer, the term of this patent is extended or adjusted under 35 U.S.C. 154(b) by 41 days.

(21) Appl. No.: 17/444,415

(22) Filed: Aug. 4, 2021

(65) Prior Publication Data

US 2022/0042356 A1 Feb. 10, 2022

(30) Foreign Application Priority Data

Aug. 7, 2020 (DE) ..... 10 2020 210 023.3
Jul. 13, 2021 (DE) ..... 10 2021 207 411.1

(51) Int. Cl.
*E05B 85/10* (2014.01)
*E05B 81/06* (2014.01)

(52) U.S. Cl.
CPC ..... *E05B 85/107* (2013.01); *E05B 81/06* (2013.01)

(58) Field of Classification Search
CPC ..... E05B 81/06; E05B 85/103; E05B 85/107
See application file for complete search history.

(56) References Cited

U.S. PATENT DOCUMENTS 5,123,687 A 6/1992 Pfeiffer et al.
9,605,452 B2 * 3/2017 Yoshino ..... E05B 85/107
2003/0019261 A1 * 1/2003 Wittwer ..... E05B 85/107 292/336.3
2013/0079984 A1 * 3/2013 Aerts ..... G07C 9/00944 292/336.3
2018/0171686 A1 * 6/2018 Couto Maquieira . E05B 85/107
2018/0216373 A1 * 8/2018 Torkowski ..... E05B 85/18
2018/0252009 A1 * 9/2018 Porada ..... E05B 85/103
(Continued)

FOREIGN PATENT DOCUMENTS

CN 105507699 B * 10/2017
CN 107923200 A 4/2018
(Continued)

OTHER PUBLICATIONS

Espacenet, machine generated translation of DE 102009018803 A1, Apr. 27, 2023. (Year: 2023).*
(Continued)

*Primary Examiner* — Kristina R Fulton
*Assistant Examiner* — Emily G. Brown
(74) *Attorney, Agent, or Firm* — Marshall & Melhorn, LLC

(57) ABSTRACT

A door handle arrangement may have a carrier element, a handle element, which is movably arranged on the carrier element between a non-use position and a use position, and an adjusting mechanism for adjusting the handle element relative to the carrier element. The adjusting mechanism may have at least one lever and a cam carrier having at least one main cam for the controlled movement of the handle element between the non-use position and the use position. The main cam may interact with a cam counter surface arranged on the lever and may have a variable curve shape.

17 Claims, 22 Drawing Sheets

(56) References Cited

U.S. PATENT DOCUMENTS

| | | | | |
|---|---|---|---|---|
| 2019/0234117 | A1* | 8/2019 | Bextermöller | E05B 85/103 |
| 2019/0234122 | A1* | 8/2019 | Löw | E05B 85/103 |
| 2020/0080351 | A1* | 3/2020 | Guerin | E05B 85/107 |
| 2020/0102773 | A1* | 4/2020 | Sobecki | E05B 85/103 |
| 2020/0332575 | A1* | 10/2020 | Christensen | E05B 85/18 |
| 2020/0347651 | A1* | 11/2020 | Velicanin | E05B 85/103 |
| 2021/0156178 | A1* | 5/2021 | Heyduck | E05B 81/42 |
| 2021/0332620 | A1* | 10/2021 | Rhein | E05B 85/103 |
| 2022/0195763 | A1* | 6/2022 | Toyama | E05B 85/107 |

FOREIGN PATENT DOCUMENTS

| | | | | | |
|---|---|---|---|---|---|
| CN | 108360931 | A | * | 8/2018 | E05B 85/10 |
| CN | 109983190 | A | | 7/2019 | |
| CN | 110036171 | A | | 7/2019 | |
| DE | 4002963 | C1 | | 7/1991 | |
| DE | 102009018803 | A1 | * | 10/2010 | E05B 81/04 |
| DE | 102015115673 | A1 | | 3/2017 | |
| FR | 3024173 | A1 | * | 1/2016 | E05B 85/107 |
| WO | 2016113339 | A1 | | 7/2016 | |

OTHER PUBLICATIONS

The State Intellectual Property Office of People's Republic of China, Office Action in Application CN202110900408.4, dated Jun. 21, 2022.

* cited by examiner

DOOR HANDLE ARRANGEMENT AND VEHICLE DOOR

FIELD

The invention relates to a door handle arrangement, in particular an outside door handle arrangement, and a vehicle door having such a door handle arrangement.

BACKGROUND

Door handle arrangements for vehicle doors of a vehicle are generally known. Vehicle doors typically comprise an outer door handle which is mechanically or electrically coupled to a locking mechanism. For example, actuating the door handle moves the locking mechanism from a locked position into an unlocked position in order to allow the vehicle door to be opened. The vehicle door comprises, for example, a door handle in which an outer handle surface is positioned so as to be approximately flush with an outer door surface of an outer vehicle door wall when the door handle is in an idle or non-use position. By means of an adjusting mechanism, the door handle can be moved outward into an operating or use position, such that it can be grasped by a user.

SUMMARY

The object of the present invention is to provide an improved door handle arrangement which allows safe guidance when placing a handle element in a use position or back in a non-use position. A further object of the invention is to specify a vehicle door with an improved door handle arrangement.

According to the invention, the object is achieved by a door handle arrangement having the features specified in the claims. With regard to the vehicle door, the problem is solved according to the invention by the features of the claims.

Further developments of the invention are the subject matter of the dependent claims. A door handle arrangement according to the invention comprises at least one carrier element and one handle element, which is movably arranged on the carrier element between a non-use position and a use position, as well as an adjusting mechanism for adjusting the handle element relative to the carrier element, wherein the adjusting mechanism comprises at least one lever and a cam carrier having at least one main cam for the controlled movement of the handle element between the non-use position and the use position, and wherein the main cam interacts with a counter surface arranged on the lever and has a variable curve shape, in particular a variable cam pitch.

Such a door handle arrangement having a main cam having a variable curve shape, in particular a variable cam pitch, allows a force-optimized adjustment of the handle element between the non-use position and the use position. The advantages that can be achieved with the invention are in particular that by means of such a variable curve shape, for example, a plurality of cam portions with different curve shapes and correspondingly different adjustment forces are made possible during an adjustment movement of the handle element. For example, releasing or adjusting the handle element in different states, for example when the handle element is frozen, when extending and/or in one of the end positions, can be supported accordingly. In particular, the cam portions can be designed such that a large part of an adjustment force to be applied, in particular a force of a motor or a manual operation, is applied for a small handle stroke at the beginning of an opening movement of the handle element in order to release a frozen handle element using this large force, for example.

For example, the main cam has at least two cam portions with different curve shapes, in particular pitches. In one possible embodiment, a first cam portion has a smaller pitch than a second cam portion. A pitch is understood to mean the increase in the cam radius per angle of rotation. A third cam portion has a substantially constant pitch. In other words: The third cam portion has an approximately equal cam radius per angle of rotation of the cam.

In one possible embodiment, the first cam portion has such a first curve shape, in particular such a first pitch curve, that the main cam and the lever are arranged so as to be spaced apart from one another in the non-use position, in particular at a small distance from one another, for example in the size of an air gap. When the handle element is adjusted into the use position, the main cam and the lever for controlling the extension movement of the handle element engage with one another. In the use position, the main cam and the lever are in a blocking or locking engagement, so that the handle element is fixed in the use position. This first cam portion comes into engagement, in particular frictional engagement, with the counter surface on the lever when the handle element is set or is in the use position.

This first cam portion, in particular this first curve shape, is designed such that the force required to release the handle element from the non-use position can be overcome when the cam is moved in the opening direction. In addition, the first curve shape can be designed such that the force required to release a frozen handle element is overcome. In addition, the cam may have a cam offset that serves as an end stop. In the non-use position of the handle element, one end face of the lever abuts against the cam offset.

For this purpose, the first cam portion has, for example, a particularly short and slight pitch. For example, the cam radius doubles over an angle of rotation of 180° of the cam in the first cam portion. The first cam portion is designed in particular such that a rotation of the main cam in a first rotational angle range of 160° to 200°, in particular 180°, causes a first opening or closing movement of the handle element in an adjustment range of 4 mm to 7 mm, in particular 5.5 mm.

In a further embodiment, the second cam portion has such a curve shape, in particular a long and steep pitch, that the main cam and the lever can be moved relative to one another in order to place the handle element in the use position. For example, the cam radius triples or quadruples over an angle of rotation of 180° of the cam in the second cam portion. The second cam portion can for example be designed such that a rotation or pivoting of the main cam in a second rotational angle range of 160° to 200°, in particular 180°, causes a second opening movement of the handle element in a range of 25 mm to 30 mm, in particular 27.5 mm.

In a further embodiment, the third cam portion has such a curve shape, in particular a largely constant or very slight pitch, that the main cam and the lever come into blocking engagement in the use position. This third cam portion comes into the blocking or locking engagement, in particular a frictional engagement, with the counter surface on the lever when the handle element is placed in the use position. This third cam portion is designed such that a force required to release this engagement can be overcome when the cam is moved in the closing direction. Depending on the type and design of the drive, in particular in the case of a motor drive, the cam portion can be configured such that the handle element cannot be pushed into the non-use position by hand.

Another aspect provides that the cam carrier comprises a plurality of main cams which are designed to correspond to one another. This allows for a safe adjustment movement. Each main cam can be designed as a disc or roller.

Alternatively or additionally, the adjusting mechanism can couple the handle element and the carrier element with one another, wherein the adjusting mechanism, the handle element, and the carrier element are designed and are in operative connection with one another in the use position of the handle element such that the handle element is fixed or is held without play in the use position.

The advantages achieved with this fixing of the handle element in the use position are in particular that a robust door handle arrangement is made possible by such fixing or holding the handle element without play in the use position thereof, in particular an extended position, in which a user grasps the handle element to open the vehicle door. In particular, such a door handle arrangement with such a fixed, in particular pretensioned, handle element in its use position allows a low-noise and secured position of the handle element in the use position thereof as well as better haptics for the user.

The handle element can be designed to be electrically or mechanically movable. For an electrical extension movement of the handle element, a drive device, for example a motor, is provided which interacts with the adjusting arrangement in order to move and set the handle element from the non-use position into the use position or vice versa when the drive device is in operation.

Another embodiment provides that the handle element is arranged translationally on the carrier element, in particular parallel to the vehicle door, or in a rotationally movable manner.

In addition, the adjusting mechanism can comprise an adjusting arrangement. By means of the lever, for example, the handle element can be moved relative to the carrier element between the non-use position and the use position. By means of the lever and the adjusting arrangement, the handle element is fixed, in particular held under tension, at least in the use position. As a result, the handle element is held firmly in its use position and, in particular, is held without play. Such an adjusting mechanism is robust and simple. In addition, such an adjusting mechanism allows for simple optional variants, such as a stepped gear, in particular a single-step worm gear, drive symmetry with two drive cams, a variable cam pitch, a direct drive, and functions such as a handle element that can extend both translationally and rotationally. In addition, such a door handle arrangement is designed to optimize installation space, in particular in the Y direction of a coordinate system. The coordinate system comprises a vertical axis Z, which runs parallel to the vehicle's vertical alignment, a longitudinal axis X, which runs parallel to the vehicle's longitudinal direction, and a transverse axis Y, which runs parallel to the vehicle's transverse direction.

Another aspect provides that the adjusting mechanism comprises a main axis by means of which the lever is mounted on the carrier element and is movably mounted relative thereto. In addition, the adjusting mechanism comprises a secondary axis by means of which the handle element is mounted on the lever and is movably mounted relative thereto. Such a two-axis adjusting mechanism allows for a safe extension and retraction movement of the handle element. In addition, the handle element and the carrier element comprise mutually corresponding end stops for the use position. Such a combination of a two-axis adjusting mechanism with corresponding end stops in the use position stabilizes the end position of the handle element in its use position on the carrier element. By means of the adjusting arrangement, in particular a cam arrangement, the end stops and thus the handle element are also held under tension on the carrier element without play and are fixed in the use position.

Another aspect of the invention provides that the adjusting arrangement comprises at least one handle support element which is arranged between the handle and the lever. The handle support element is designed, for example, as a spring element, in particular a leaf spring. The handle support element is arranged between the handle bar and the lever such that the handle is held under tension both in the retracted position or in the non-use position and in the extended position or in the use position. As a result, the handle is quiet for the most part. In particular, during an adjustment movement of the handle from the non-use position to the use position or vice versa, the handle is held under tension between the handle bar and the lever by means of the handle support element, in particular held under tension against the support element, in particular supported resiliently against the carrier element. In the non-use position, a free space, in particular a gap, is formed between an inner handle part, in particular an inner handle bar, and the support element.

In addition, the adjusting mechanism, in particular the adjusting arrangement, comprises, in a further embodiment, the cam carrier with an associated cam axis in order to guide the handle element between the non-use position and the use position in a controlled manner.

In a further embodiment, the cam carrier comprises at least the main cam arranged on the cam carrier for the controlled movement of the handle element between the non-use position and the use position. The main cam is designed, for example, as a disc with a curved or arcuate projection, in particular a cam disc. When the handle element is adjusted, a rotational movement of the adjusting arrangement about the cam axis and thus a rotational movement of the main cam is converted into a translational movement, in particular into a translational extension or retraction movement, of the handle element. The curved or arcuate projection of the at least one main cam has a variable pitch, for example. As a result, the door handle arrangement is designed to absorb mechanical forces greater than 250 N when the handle element is actuated, as can occur, for example, when a frozen door handle is opened.

In addition, the adjusting mechanism can comprise at least one auxiliary cam arranged on the cam carrier for controlling the retraction movement of the handle element from the use position into the non-use position and/or for spring decoupling of a return spring arrangement for the handle element. By means of such an auxiliary or secondary cam for controlling the retraction movement and/or spring decoupling, the drive device, in particular a motor, can be made smaller. In addition, such an auxiliary or secondary cam for spring decoupling makes the door handle arrangement less susceptible to wear and silent.

Another aspect provides that the lever comprises at least one cam guide in or on which the cam carrier is guided when the handle element is adjusted between the non-use position and the use position. For example, the cam guide is designed as a guide groove or a guide slot.

In addition, the carrier element can comprise at least one handle guide in which or on which the handle element is guided when it is adjusted between the non-use position and the use position. For example, the handle guide is designed as a link guide. In particular, the handle guide is set up such that the handle element can be moved translationally and in particular parallel to the vehicle outer skin. In particular, the handle guide has such a link shape, in particular a sliding or guide shape, such that possible manufacturing and/or assembly deviations, in particular angular deviations, are or will be compensated.

The door handle arrangement can also comprise additional functional units, such as actuator electronics, for example with a Hall sensor for the controlled extension of the handle element and for activating the drive device, a mechanical emergency actuation means, for example in the form of mechanical buttons and lock cylinders, handle electronics, for example with close-range and/or long-range sensors, for detecting an approach of a user, handle lighting, for example recess lighting and/or exterior lighting. The handle element can also comprise components of a keyless entry system, for example a capacitive sensor on the outside for locking and on the inside for unlocking. The capacitive sensor (also called M(etal)O(ver)C(apacity)) reacts to changes in the distance to a protective element and is used to generate an opening/unlocking signal.

As an alternative or in addition to the electrically operated door handle arrangement, it can also be operated manually. For this purpose, the door handle arrangement additionally or alternatively comprises a manual switching element, for example a slide or a push switch (also called a push element). When the switching element is actuated, the handle element is moved from the non-use position into the use position due to a movement coupling of the switching element with the actuation element. To trigger or open the door lock, if the handle element is not extended in parallel, this handle element can be moved, for example, by means of a vertical movement.

A vehicle door is equipped with at least one door handle arrangement as described above. In particular, the door handle arrangement is designed as an outside door handle arrangement. The door handle arrangement has a compact, in particular compact in the Y direction, low-wear, and cost-effective structure.

DESCRIPTION OF THE FIGURES

Embodiments of the invention are explained in greater detail with reference to drawings, in which.

Parts corresponding to each other are provided with the same reference signs in all figures.

DETAILED DESCRIPTION

Figure 1:
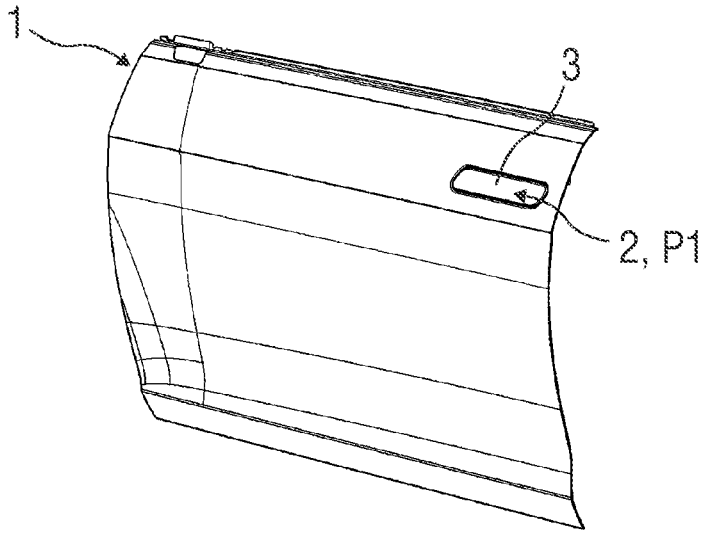
FIG. 1 is a schematic perspective view of a vehicle door having a door handle arrangement having a handle element in a non-use position.

FIG. 1 shows a schematic perspective illustration of a vehicle door 1 with a door handle arrangement 2. The door handle arrangement 2 is designed as an outside door handle arrangement.

The door handle arrangement 2 comprises a handle element 3, in particular an outer door handle. The handle element 3 can be mechanically or electrically coupled to a locking mechanism for a door lock (not shown). For example, actuating the handle element 3 moves the locking mechanism from a locked position into an unlocked position in order to allow the vehicle door 1 to be opened.

The handle element 3, in particular an outer handle surface of the handle element 3, is positioned approximately flush with an outer door surface of an outer vehicle door wall when the handle element 3 is in a non-use position P1, as shown in FIG. 1. In other words: In the non-use position P1, the handle element 3 is arranged, in particular lowered, in a recess made in the vehicle door 2, such that the door handle 3 complements an outer contour of the vehicle door 2, in particular ends flush therewith.

Figure 2:
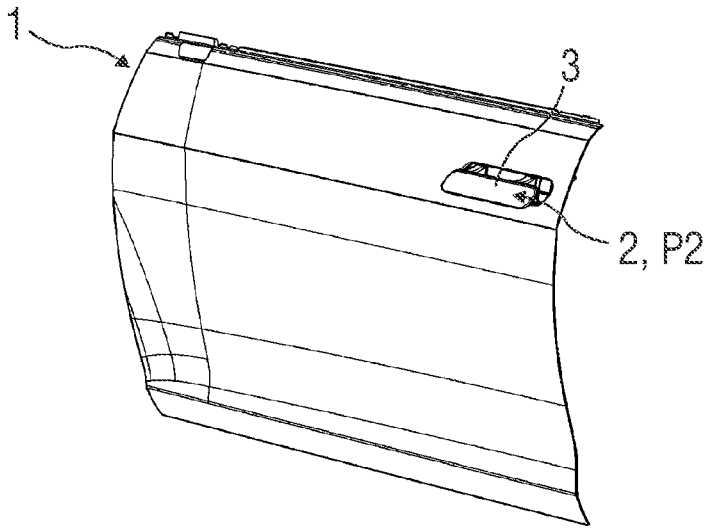
FIG. 2 is a schematic perspective view of a vehicle door having a door handle arrangement having a handle element in a use position.

FIG. 2 is a schematic perspective view of the vehicle door 1 having the door handle arrangement 2 having the handle element 3 in a use position P2.

In order to operate it, the handle element 3 can be moved, in particular extended, from the non-use position P1 into the use position P2 opposite and relative to the vehicle door 1. In this use position P2, the handle element 3 can be actuated by a user.

Figure 3:
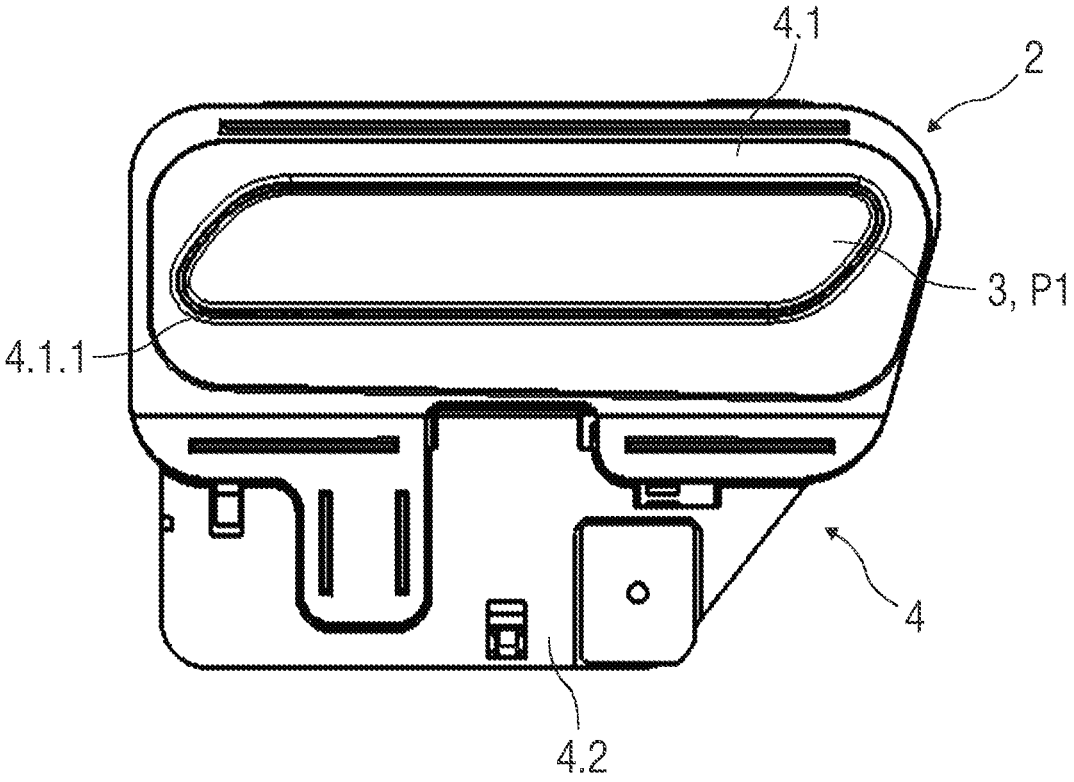
FIG. 3 is a schematic plan view of an embodiment of a door handle arrangement having a handle element in a non-use position.

FIG. 3 is a schematic plan view of an embodiment of the door handle arrangement 2 having the handle element 3 in the non-use position P1.

The door handle arrangement 2 comprises a carrier element 4. The handle element 3 is movably arranged on the carrier element 4. The carrier element 4 can be formed in one piece or in multiple pieces.

In the embodiment shown, the carrier element 4 comprises a first carrier part 4.1 and a second carrier part 4.2. The first carrier part 4.1 is, for example, designed so as to be flat. The first carrier part 4.1 is arranged and held in particular on an inside of the door 1.1 (shown in FIG. 4), for example an inside of an outer door wall, of the vehicle door 1 in the region of an opening 1.2 (shown in FIG. 4) for the handle element 3. The first carrier part 4.1 has a handle opening 4.1.1 that corresponds to an outer contour of the handle element 3, in which the handle element 3 is arranged in the non-use position P1 or through which the handle element 3 is extended when it is adjusted into the use position P2.

The second carrier part 4.2 is used to movably mount the handle element 3 on the carrier element 4. The second carrier part 4.2 can also be arranged and fastened on the inside of the vehicle door 1. If the vehicle door 1 is designed so as to be double-walled, for example the door handle arrangement 1, in particular the carrier element 4, is arranged and held in an intermediate space between an outer door wall and an inner door wall of the vehicle door 1. The first carrier part 4.1 can be arranged and fastened to the door outer wall. The second carrier part 4.2 can be arranged and fastened to the door inner wall or an inner door panel.

Figure 4:
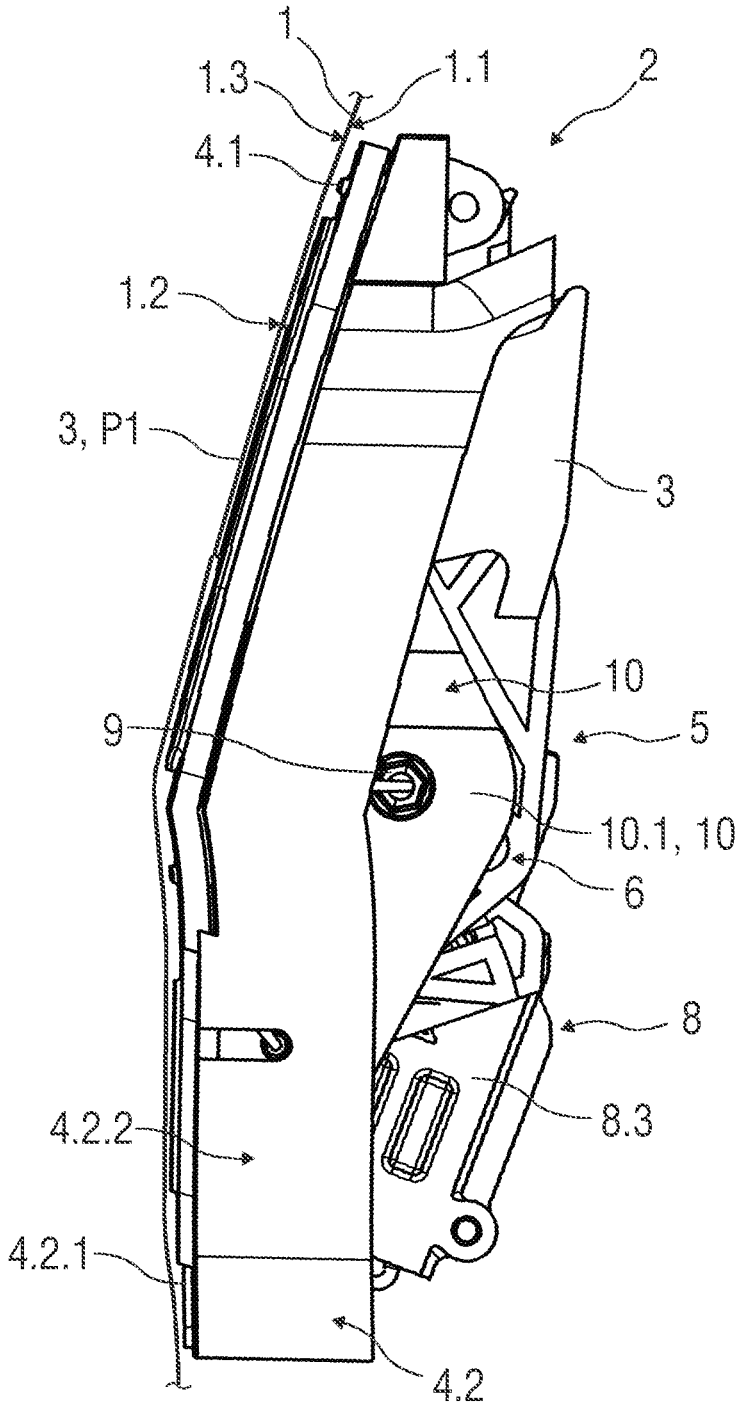
FIG. 4 is a schematic side view of a door handle arrangement having a handle element in a non-use position.

FIG. 4 shows a schematic side view of the door handle arrangement 1 having the handle element 3 in the non-use position P1. The door handle arrangement 2 is arranged on the inside of the door 1.1 such that the handle element 3 is arranged in the opening 1.2 flush with an outside of the door 1.3.

The first carrier part 4.1 is designed so as to be flat. The second carrier part 4.2 is designed so as to be partially flat and rests largely flat against an inner side of the first carrier part 4.1. The second carrier part 4.2 has a base element 4.2.1 on which the handle element 3 is movably held.

The door handle arrangement 1 also comprises an adjusting mechanism 5 which couples the handle element 3 and the carrier element 4 to one another, in particular, which couples them in terms of movement.

In addition, the second carrier part 4.2 can have a circumferential edge 4.2.2 at least in some regions or completely. The circumferential edge 4.2.2 serves to cover the internal adjusting mechanism 5 in some regions, for example at least laterally or completely circumferentially.

The adjusting mechanism 5 comprises at least one lever 6 and a cam carrier 9 for the controlled movement of the handle element 3 between the non-use position P1 and the use position P2.

The adjusting mechanism 5, the handle element 3, and the carrier element 4 can be designed and can be in operative connection with one another such that the handle element 3 is additionally fixed in this use position P2, in particular held without play and in the use position P2 (shown in FIG. 5) of the handle element 3.

Figure 5:
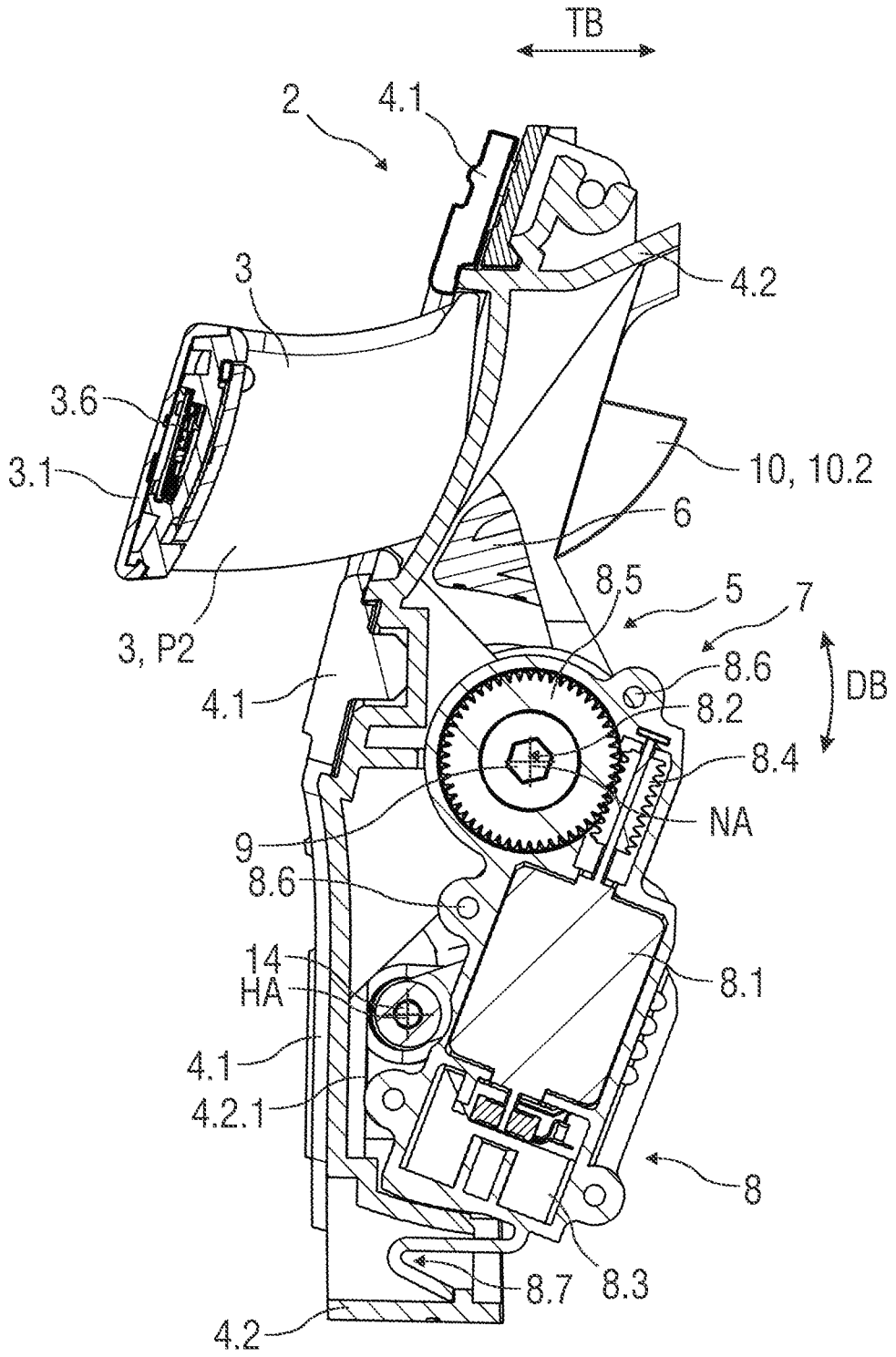
FIG. 5 is a schematic side view of a door handle arrangement having a handle element in a use position without a side cover.

FIG. 5 shows a schematic side view of the door handle arrangement 1 having the handle element 3 in the use position P2 and without the side cover, in particular without the edge 4.2.2 and in a partial sectional view of the adjusting mechanism 5.

The adjusting mechanism 5 comprises the at least one lever 6, by means of which the handle element 3 can be moved relative to the carrier element 4 between the non-use position P1 and the use position P2. In addition, the door handle arrangement 1, in particular the adjusting mechanism 5, comprises an adjusting arrangement 7 (shown in detail in FIG. 6A to 6C), by means of which the handle element 3 is fixed at least in the use position P2, in particular held under tension with respect to the lever 6.

The handle element 3 can be designed to be electrically or mechanically movable. For an electrical extension movement of the handle element 3, a drive device 8 is provided, which interacts with the adjusting mechanism 5, in particular a cam carrier 9, and the adjusting arrangement 7, in particular the lever 6, in order to move and set the handle element 3, during the operation of the drive device 8, from the non-use position P1 into the use position P2 or vice versa. The drive device 8 comprises at least one motor 8.1, a gearbox 8.2, and a housing 8.3. The motor 8.1 is designed as a worm gear motor and comprises a worm shaft 8.4 which drivingly engages a worm wheel 8.5 of the gearbox 8.2 and thus drives it, the axes of the worm shaft 8.4, and the worm wheel 8.5 being arranged at right angles to one another.

The cam carrier 9 is designed as a camshaft and has a cam axis NA. The axis of the worm wheel 8.5 corresponds to the cam axis NA of the cam carrier 9 of the adjusting arrangement 7. The cam carrier 9 is designed in the form of a transmission rod, a bearing pin, or a shaft.

The drive device 8, the adjusting arrangement 7 having the lever 6, and the adjusting mechanism 5 having the cam carrier 9 and the carrier element 4 interact in such a way when the handle element 3 is adjusted that this handle element 3 is movable, in particular is retractable or extendable, in particular parallel and relative to the vehicle door 1, translationally between the non-use position P1 and the use position P2. For this purpose, the worm shaft 8.4 drives the worm wheel 8.5, which in turn drives the cam carrier 9, which is non-rotatably connected to the driven worm wheel 8.5, and thus also rotates. The drive device 8 is held in a form-fitting or force-fitting manner on the second carrier part 4.2. For example, the drive device 8 is held on the second carrier part 4.2 by means of screw connections 8.6 and/or latching connections 8.7.

In addition, the handle element 3 can comprise handle electronics 3.6, for example with close-range and/or long-range sensors, for detecting an approach of a user, handle lighting, for example recess lighting and/or exterior lighting. The handle element 3 as handle electronics 3.6 can also comprise components of a keyless entry system, for example a capacitive sensor on the outside for locking and on the inside for unlocking.

Figure 11:
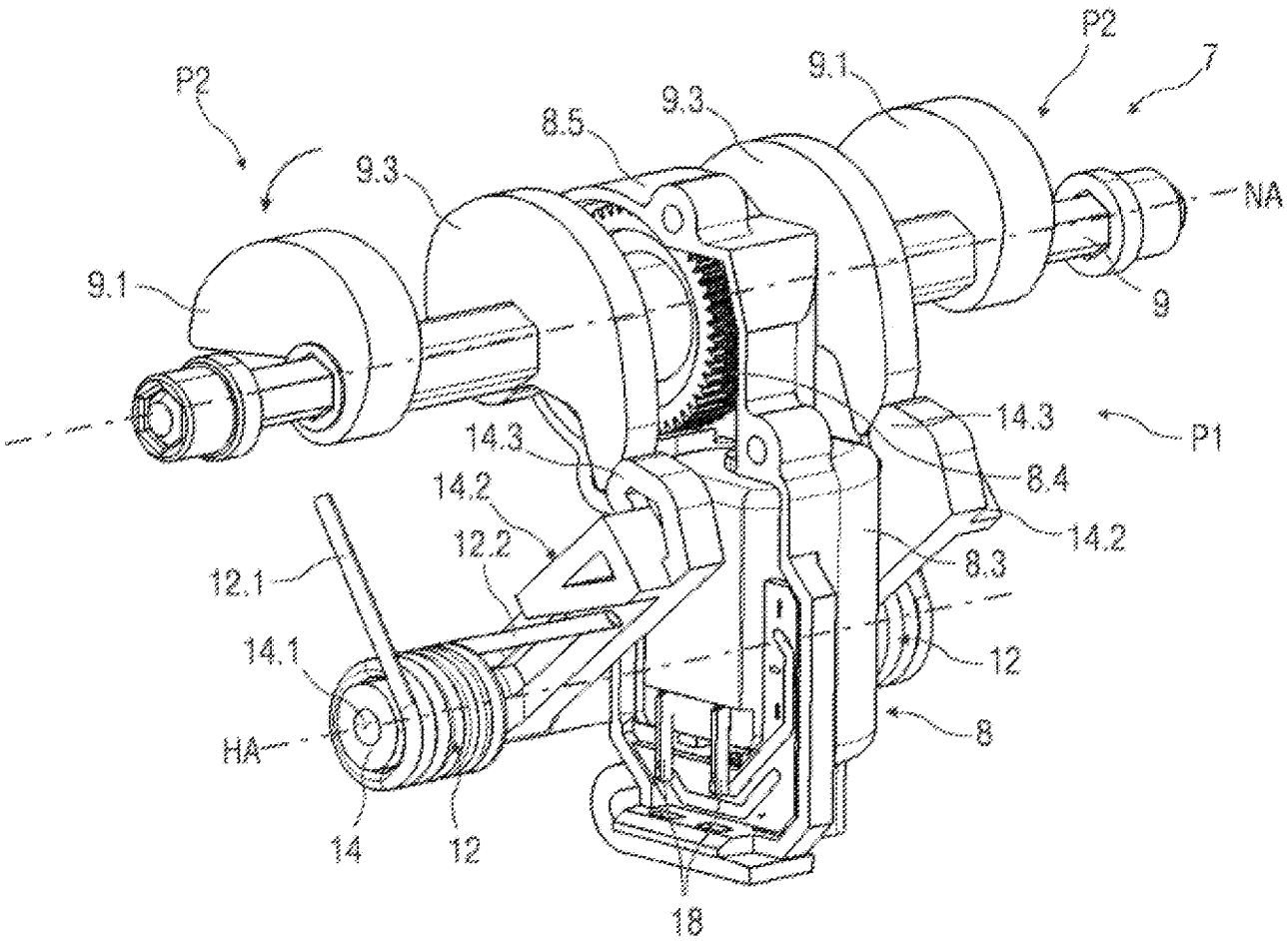
FIG. 11 is a schematic perspective view of an adjusting mechanism of an electrically operated door handle arrangement without a lever arrangement.
Figure 11A:
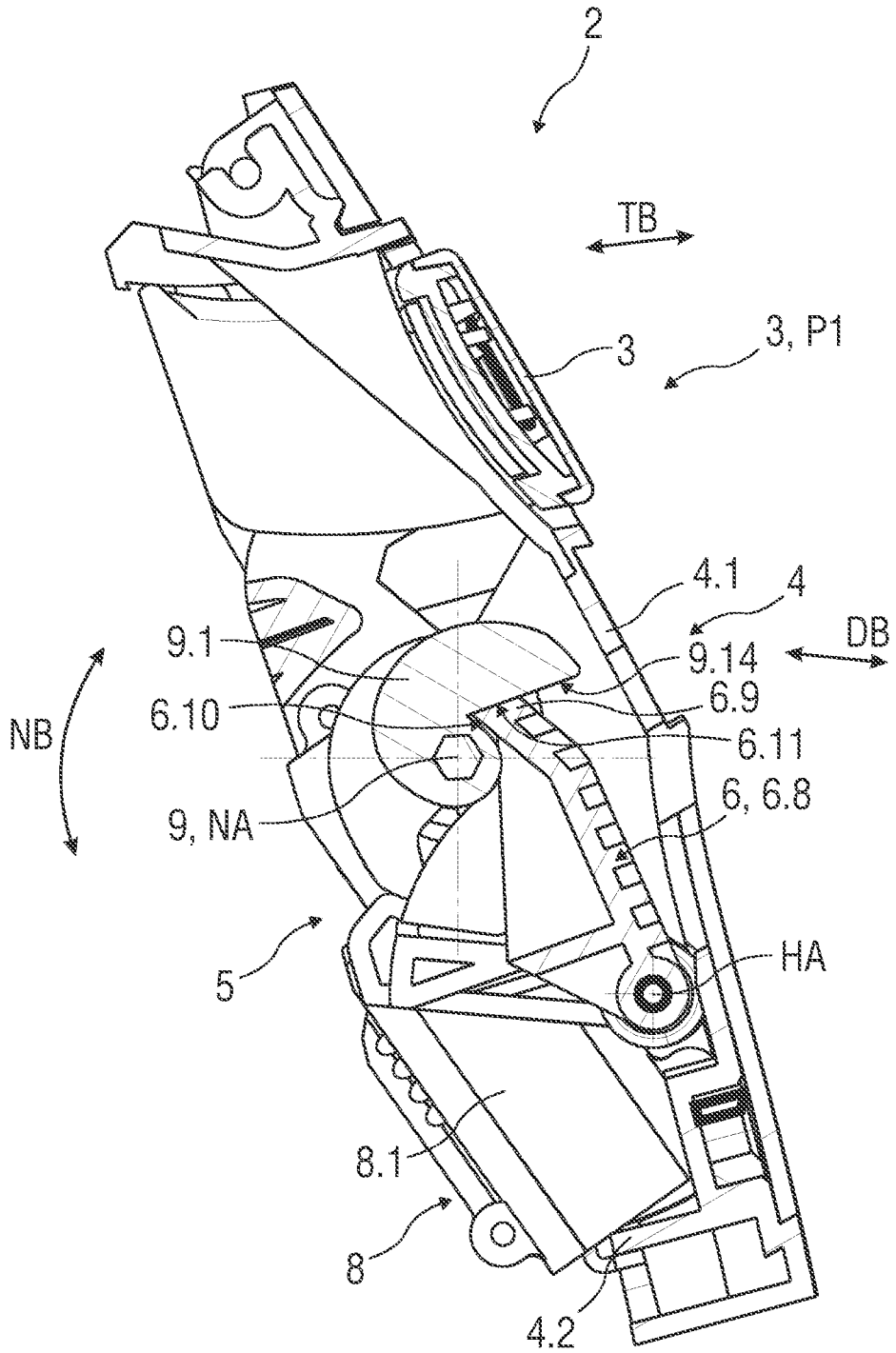
FIGS. 11A, 11C, and 11D are schematic sectional views of a door handle arrangement in the region of the adjusting mechanism with cam control for different positions of the handle element.
Figure 11B:
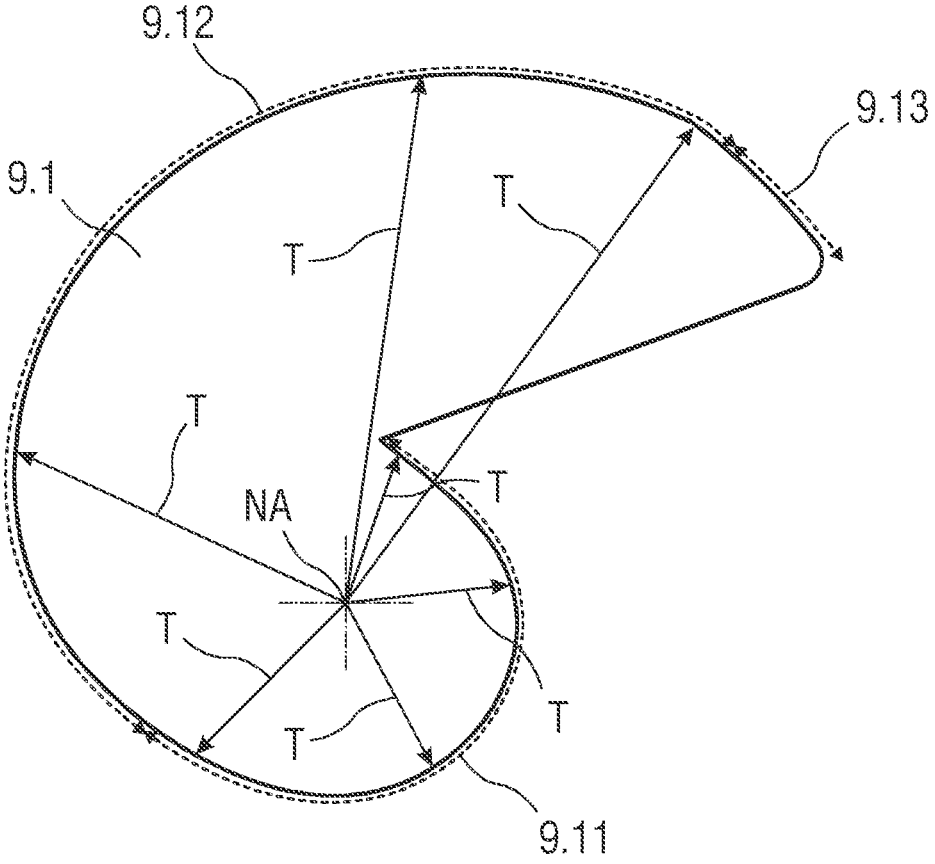
FIG. 11B is a schematic view of an embodiment of a main cam having a plurality of cam portions.
Figure 11C:
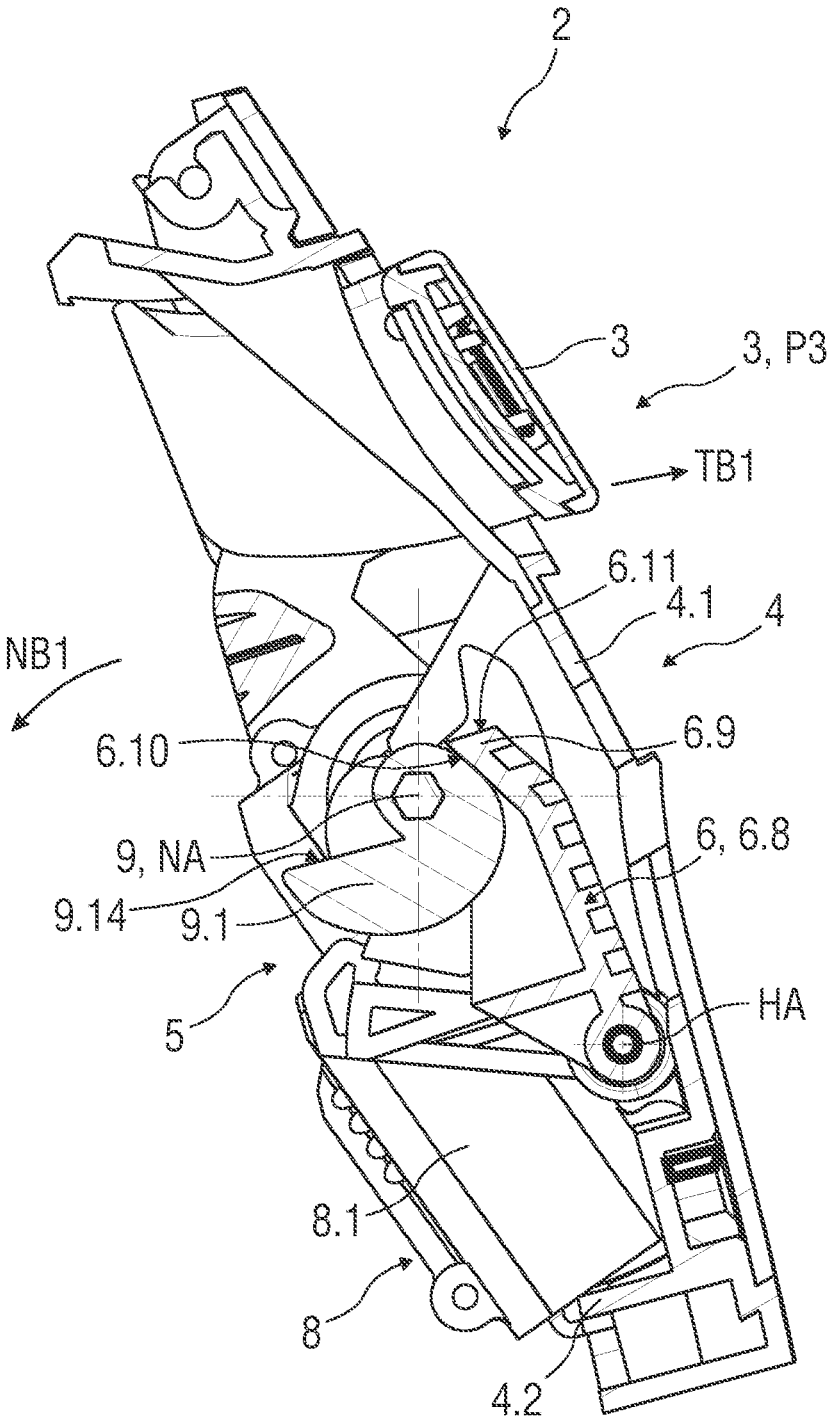

At least one main cam 9.1 (shown in FIGS. 6A and 11, 11A to 11C) for the controlled movement of the handle element 3 between the non-use position P1 and the use position P2 is arranged on the cam carrier 9, as described in detail for FIG. 11A to 11C.

For an adjustment of the handle element 3, a rotational movement DB of the adjusting mechanism 5, in particular of the cam carrier 9, generated by the motor 8.1, about the cam axis NA and the adjusting arrangement 7, in particular of the lever 6, about the main axis HA, and thus a rotational movement of the main cam 9.1, is converted into a translational movement TB, in particular into a translational extension or retraction movement, of the handle element 3.

The door handle arrangement 1 can also comprise further optional functional units.

In the embodiment according to FIGS. 4 and 5, the door handle arrangement comprises a mechanical emergency actuation unit 10. The emergency actuation unit 10 comprises one or more manual actuation elements 10.1, 10.2, which is or are designed, for example, as an externally accessible rotatable switching disc or ring, flap, and/or sliding element.

Figure 16:
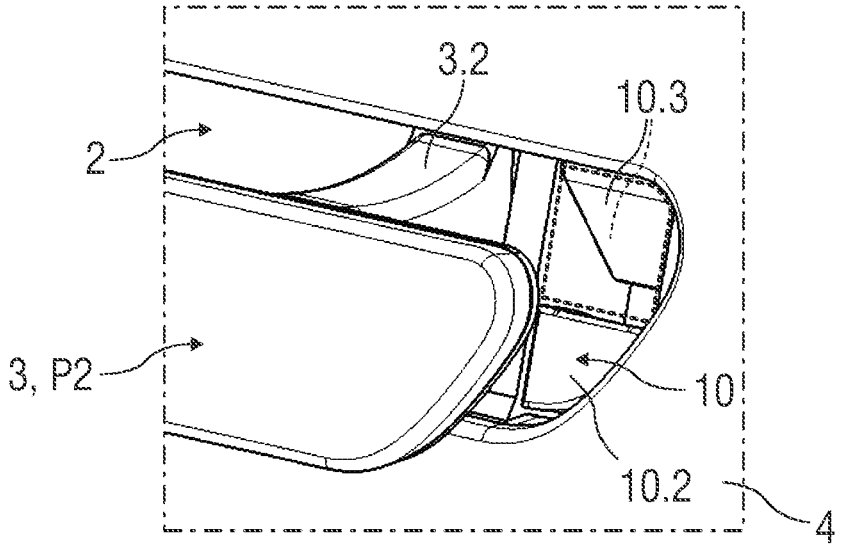
Figure 17:
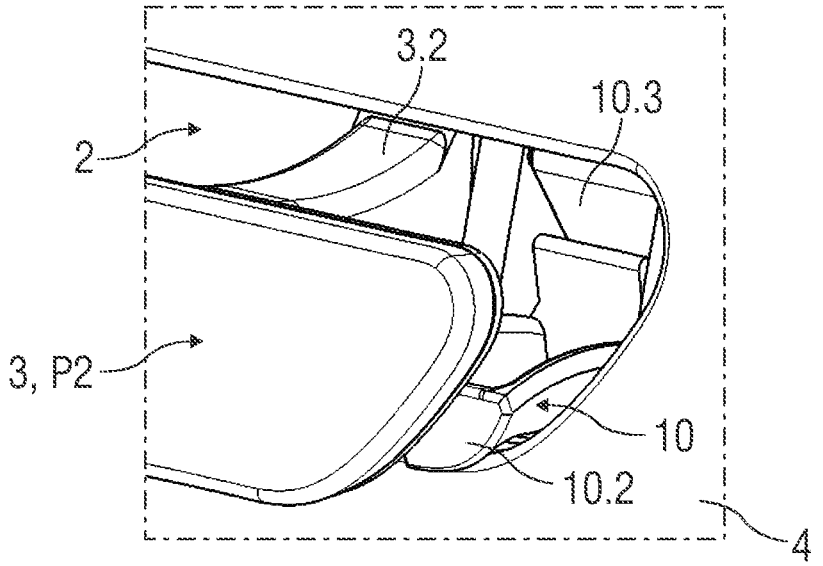

The mechanical emergency actuation unit 10 is described in more detail below with reference to FIGS. 16 to 18.

Figure 6A:
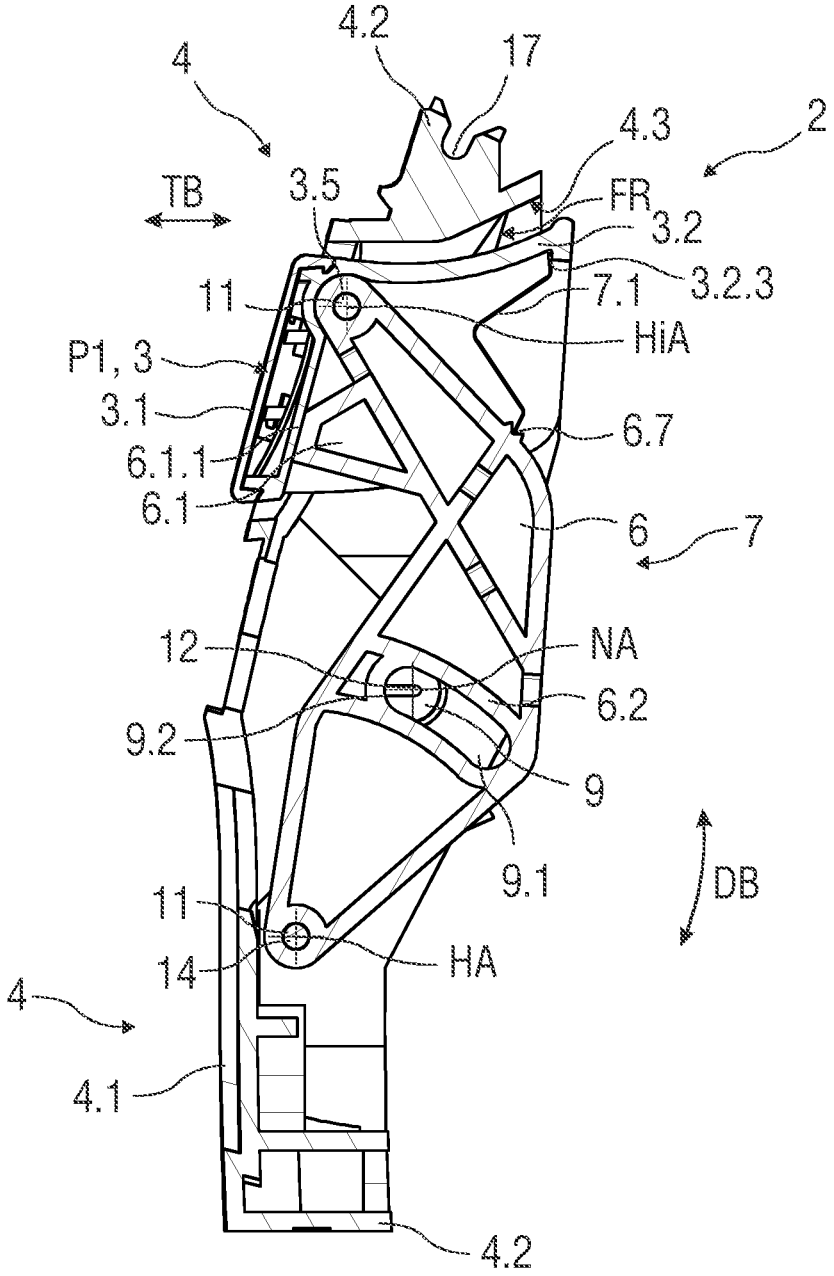
FIG. 6A to 6C are schematic sectional views of a door handle arrangement in the region of an adjusting mechanism with different positions of the handle element.
Figure 6B:
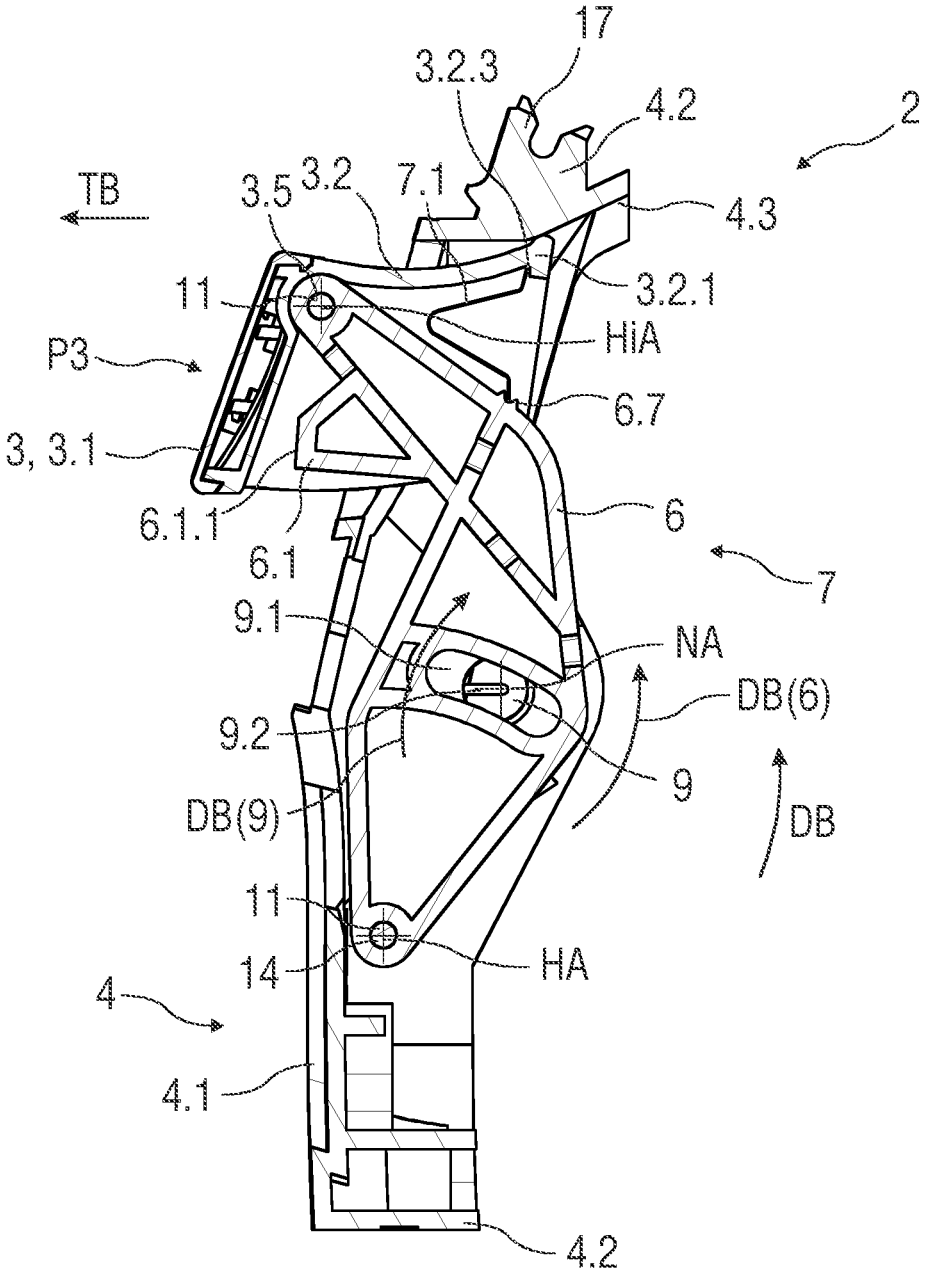
Figure 6C:
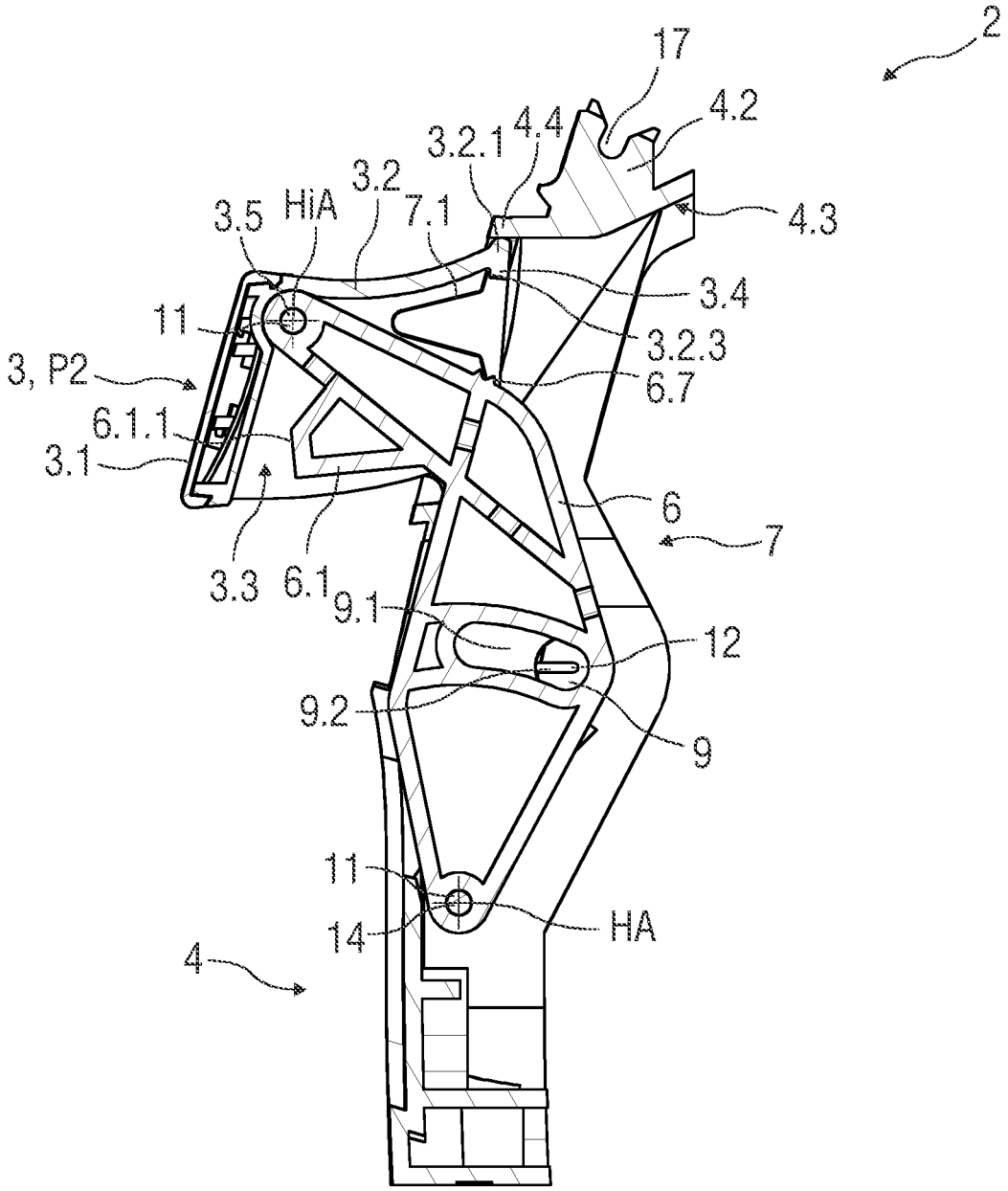

FIG. 6A to 6C are schematic sectional views of the door handle arrangement 1 in the region of the adjusting mechanism 5 and the adjusting arrangement 7 with different positions P1 to P3 of the handle element 3.

FIG. 6A shows the handle element 3 in the non-use position P1. In the non-use position P1, a free space FR, in particular a gap, is formed between an inner handle part, in particular an inner handle bar 3.2, the handle bar arms 3.2.2, and the carrier element 4, in particular the second carrier element 4.2.

The lever 6 comprises at least two axes. A first lever axis is a main axis HA of the adjusting mechanism 5. By means of a pivot bearing 11, for example a bearing pin, the lever 6 is mounted about the main axis HA on the carrier element 4 and is movably mounted relative thereto, in particular pivotably or rotationally.

In addition, the adjusting mechanism 5 comprises a secondary axis HiA, about which the handle element 3 is mounted on the lever 6 and movably, in particular rotatably, relative thereto. For this purpose, a further pivot bearing 11, in particular a bearing pin, is arranged on the secondary axis HiA. The pivot bearings 11 are arranged and held on the carrier element 4.

Such a two-axis adjusting mechanism 5 allows a safe extension and retraction movement of the handle element 3.

In addition, the lever 6 comprises a projection 6.1 projecting in the direction of the handle element 3, which projection is designed and shaped such that the handle element 3 is supported and/or fixed, in particular pretensioned, in the non-use position P1. For example, the projection 6.1 comprises a handle stop surface 6.1.1.

In addition, a handle support element 7.1 is provided, which is arranged, for example clamped or held under tension, between the handle 3, in particular the handle bar 3.2, and the lever 6. For example, one end of the handle support element 7.1 on the handle bar 3.2 is fixed to a stop 3.2.3. An opposite end of the handle support element 7.1 is, for example, defined in a form-fitting or force-fitting manner on the lever 6, in particular in a latching groove 6.7.

The handle support element 7.1 is designed, for example, as a spring element, in particular a leaf spring or clamp spring. FIG. 6A shows the handle support element 7.1 in a non-tensioned position.

The projection 6.1 strikes flat against a flat rear side of the handle element 3 in the non-use position P1 and supports the handle element 3.

The lever 6 also comprises at least one cam guide 6.2, in or on which the cam carrier 9 is guided when the handle element 3 is adjusted between the non-use position P1 and the use position P2. For example, the cam guide 6.2 is designed as a guide groove or a guide slot into which the cam carrier 9.1 is force-guided.

The handle element 3 comprises an outer handle surface 3.1 and at least one handle bar 3.2. In particular, two handle bars 3.2 are provided which are spaced apart from one another on a rear side of the handle surface 3.1, in particular are arranged parallel to one another and extend inward from the handle surface. In the region behind the handle surface 3.1 and to the side of the at least one handle bar 3.2 or behind the handle surface 3.1 and between the two handle bars 3.2, a handle recess 3.3 is formed for a hand of a user when the handle element 3 is placed in the use position P2 (see FIG. 6C).

The pivot bearing 11 of the secondary axis HiA is arranged on the handle bar 3.2. The handle bar 3.2 has a guide or sliding element 3.2.1, in particular a sliding rib or edge, which is guided in a controlled manner, in particular force-guided, on a handle guide 4.3 of the carrier element 4 when the handle element 3 is adjusted between the non-use position P1 and the use position P2. For example, the handle guide 4.3 is designed as a link guide. In this case, the handle guide 4.3 has in particular such a link shape, in particular a sliding or guide shape, such that possible manufacturing and/or assembly deviations, in particular angular deviations, are or will be compensated. The handle guide 4.3 can have an arcuate course or a rising and falling course.

The cam carrier 9 also has an axial lock 9.2. The axial securing means 9.2 can be designed, for example, as a securing bar, stop, tab, spring, rib, or clamp in order to axially secure the cam carrier 9, for example a camshaft, in particular a hexagonal shaft. The cam carrier 9 can be held secured against axial displacement at both ends by means of such an axial securing means 9.2.

FIG. 6B shows the handle element 3 in an intermediate position P3 between the use position P2 and the non-use position P1.

FIG. 6C shows the handle element 3 in one of the end positions thereof, the use position P2, in which the handle recess 3.3 is accessible to a hand of a user, for example to operate the handle element 3 and to release a locking mechanism (not shown) and to allow the vehicle door to be opened. The handle support element 7.1 is partially tensioned.

As shown in FIG. 6C, the handle element 3 and the carrier element 4 additionally comprise end stops corresponding to one another, in particular an end stop 3.4 on the handle side and an end stop 4.4 on the carrier side, which strike one another in the use position P2. The handle support element 7.1 is fully tensioned.

The main cam(s) 9.1 (shown in FIG. 11) has or have such a protruding or projecting cam contour that, when the main cam 9.1 is in the use position P2, the corresponding cam contour fixes the handle element 3 in the use position P2, in particular in a pretensioned manner. Thus, the handle element 3 is supported in the use position P2 by the main cam or cam 9.1.

Such a combination of two-axis adjusting mechanism 5 with corresponding end stops 3.4, 4.4 in the use position P2 and the main cam 9.1 supporting the handle element 3 stabilizes the end position of the handle element 3 in its use position P2 on the carrier element 4. By means of the adjusting arrangement 7, in particular the main cam(s) 9.1, the end stops 3.4, 4.4, and thus the handle element 3 are held under tension on the carrier element 4 without play and are fixed in the use position P2.

Figure 7A:
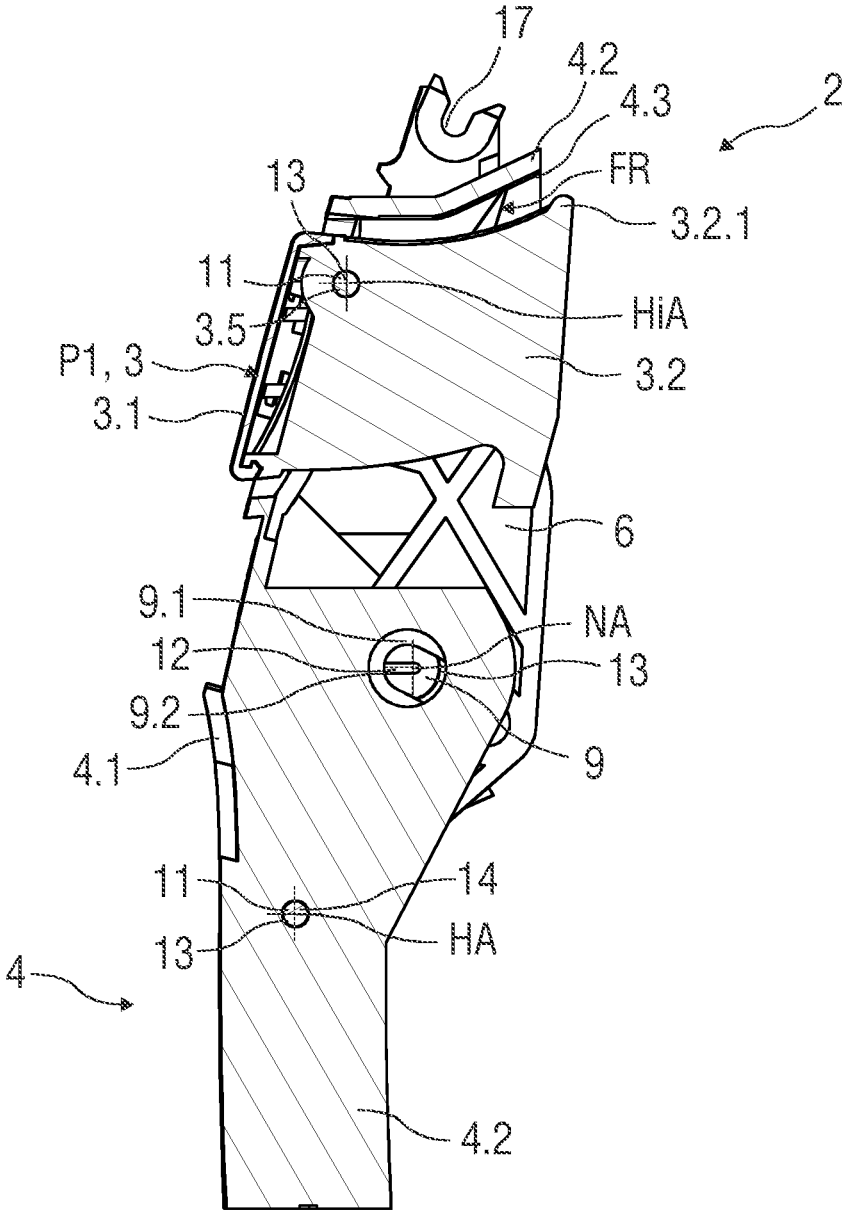
FIG. 7A to 7C are schematic sectional views of a door handle arrangement in the region of a carrier element with different positions of the handle element.
Figure 7B:
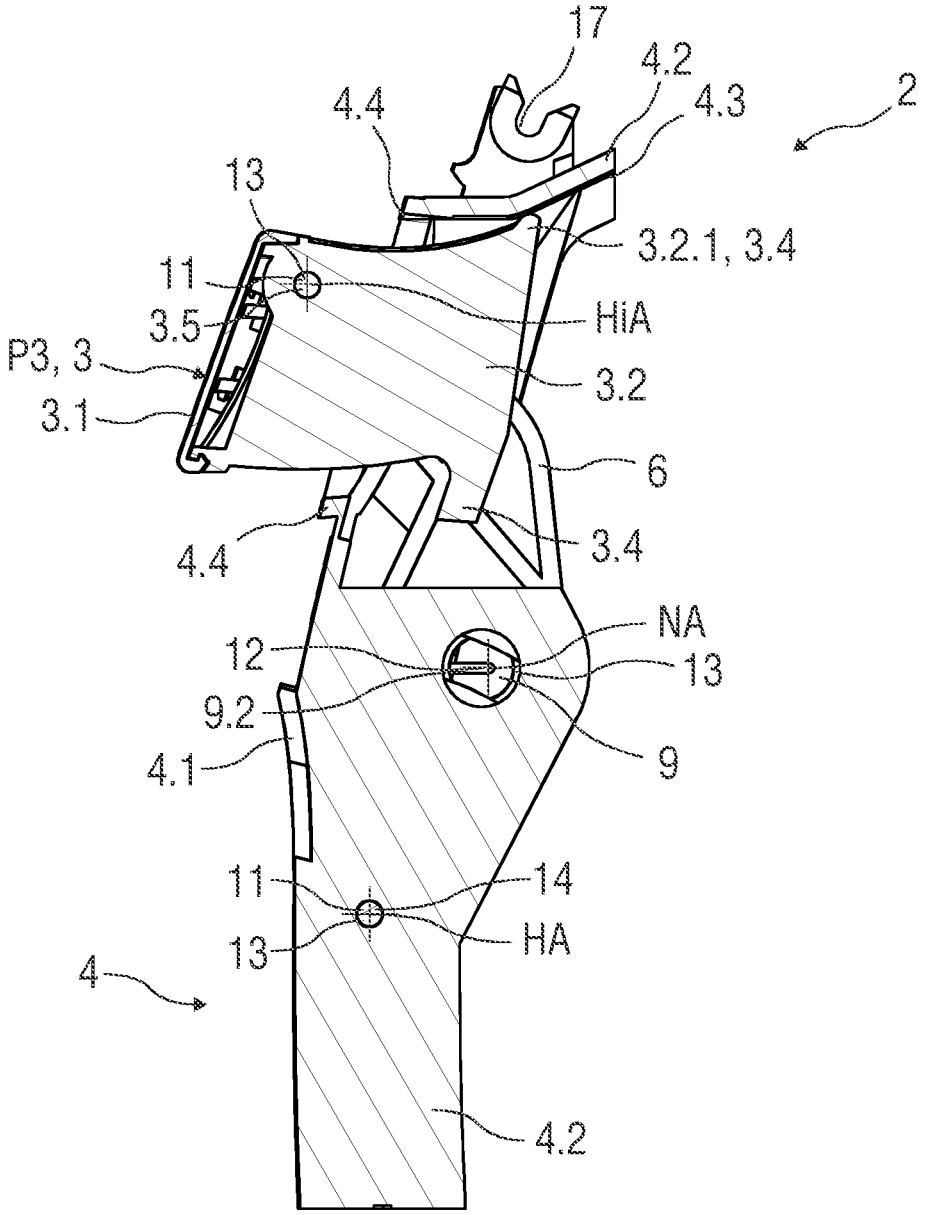
Figure 7C:
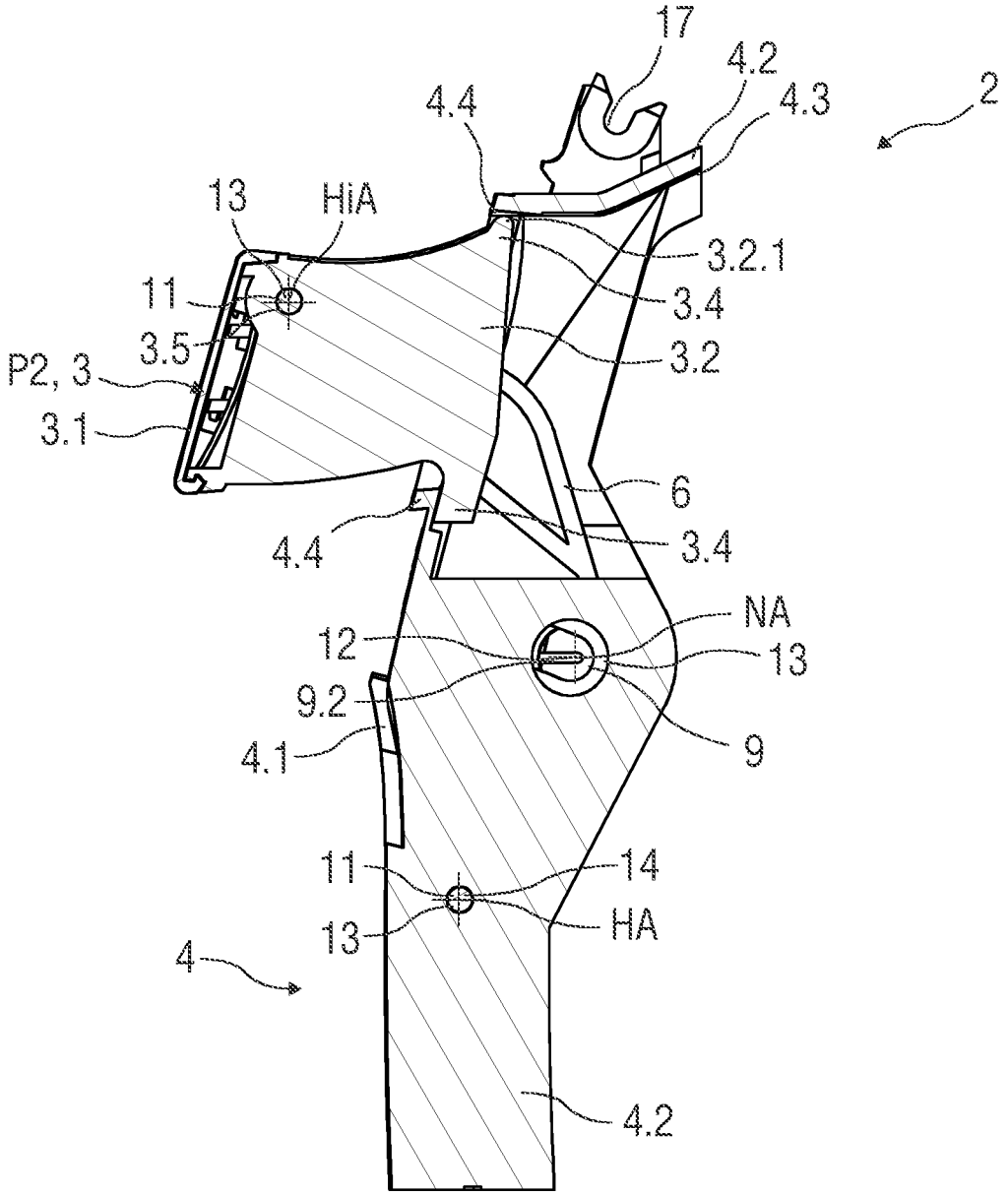

FIG. 7A to 7C are schematic sectional views of the door handle arrangement 2 in the region of the carrier element 4 with different positions P1 to P3 of the handle element 3.

The carrier element 4 has bearing openings 13 for the pivot bearings 11 of the spring carrier 14 arranged in the region of the main axis HA and the cam carrier 9 rotatable about the cam axis NA, for example in the form of a hexagonal shaft. The handle bar 3.2 also has a bearing opening 13 for the pivot bearing 11 of a handle carrier 3.5 arranged in the region of the secondary axis HiA, for example in the form of a pivot bolt or pin.

FIG. 7A shows the handle element 3 in the non-use position P1.

FIG. 7B shows the handle element 3 in the intermediate position P3 and FIG. 7C shows the handle element 3 in the use position P2.

Figure 8:
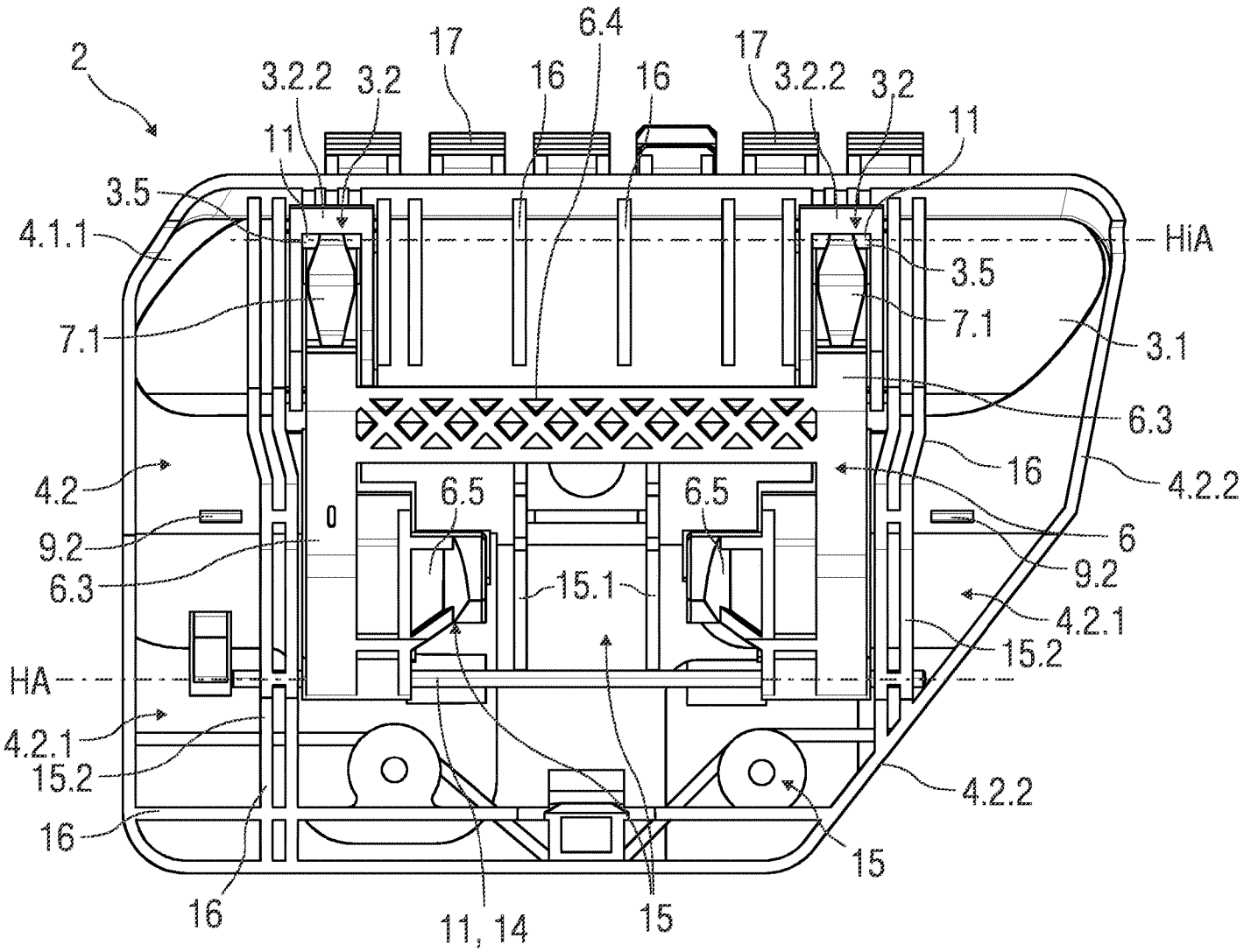
FIG. 8 is a schematic rear view of a door handle arrangement.

FIG. 8 is a schematic rear view of the door handle arrangement 2.

The handle bar 3.2 has two handle bar arms 3.2.2 arranged parallel to one another. The handle bar arms 3.2.2 are designed in the manner of a profile, in particular U-shaped.

The lever 6 comprises two lever arms 6.3 which are arranged parallel to one another and are connected to one another by means of a transverse profile 6.4, for example a cross member in a crossed rib structure.

In each case, a lever arm 6.3 is arranged in a handle bar arm 3.2 and is movably mounted thereon by means of a handle carrier 3.5, for example in the form of a bolt or pin, of the associated pivot bearing 11. In particular, each lever arm 6.3 is arranged between legs of the associated U-shaped handle bar arm 3.2 and is movably mounted by means of the handle carrier 3.5 on the pivot bearing 11 about the secondary axis HiA. The handle-side lever ends of the lever arms 6.3 supported in the handle arm 3.2 can have a shape corresponding to the U-shaped profile of the handle bar arm 3.2.

The pivot bearing 11 of the main axis HA is designed as a round profile. In addition, the pivot bearing 11 is designed as a spring carrier 14 in the region of the main axis HA and is provided for receiving the return spring 12. The return spring 12 is shown in detail in FIGS. 11 and 18.

The pivot bearing 11 of the secondary axis HiA is designed as a handle carrier 3.5, for example in the form of a bolt or pin for the handle element 3.

In addition, the carrier element 4, in particular the second carrier part 4.2 thereof, has support elements 15 on the rear or inside, such as and/or stiffening elements 16, such as ribs, webs, profiles, etc.

Figure 9:
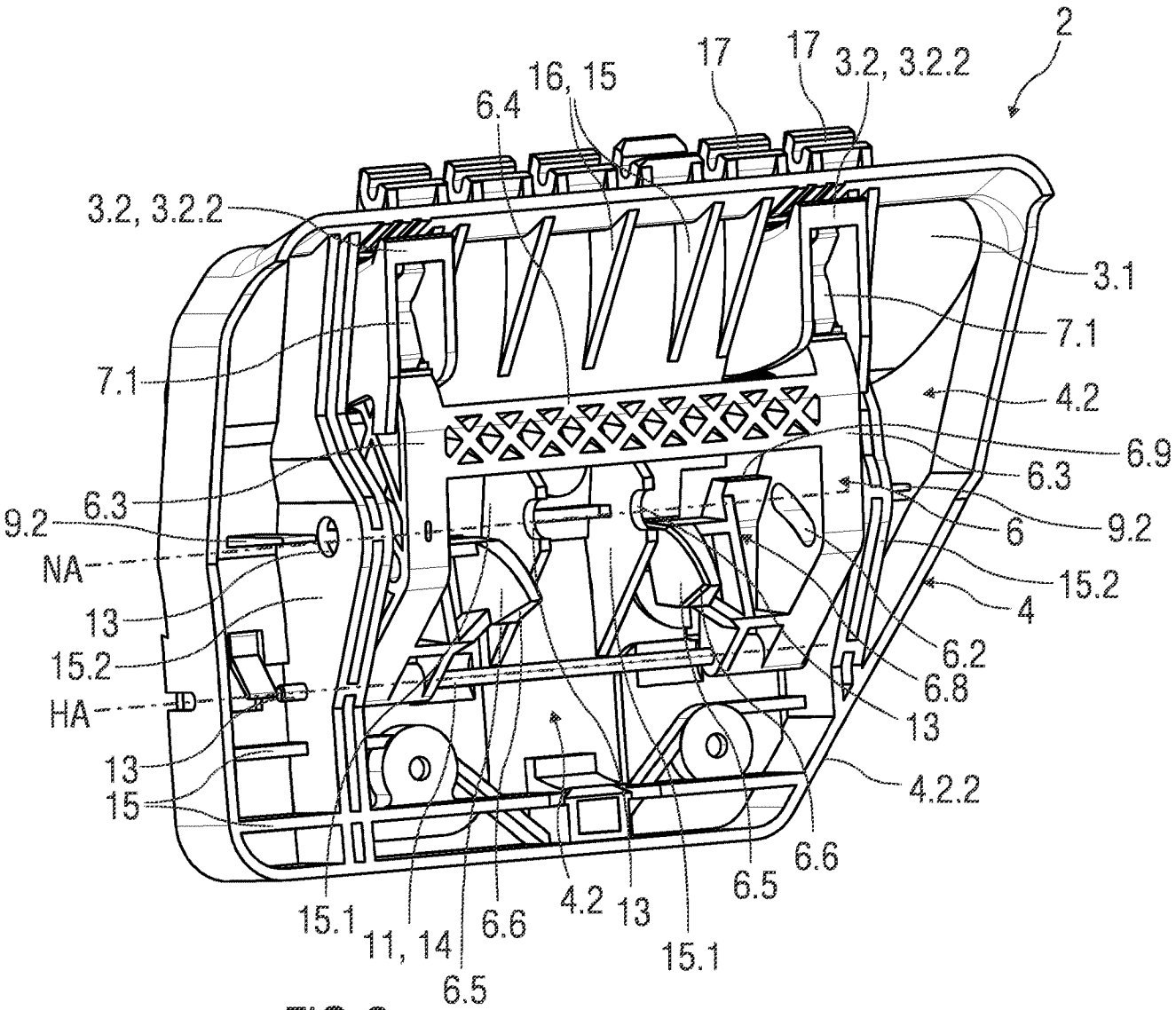
FIG. 9 is a schematic perspective view obliquely from the rear of a door handle arrangement.

The first carrier part 4.1 is not shown in detail in FIGS. 8 and 9. The second carrier part 4.2 has, for example, a fastening element 17, in particular a latching means or a latching receptacle, for receiving a corresponding fastening means of the first carrier part 4.1.

FIG. 9 is a schematic perspective view obliquely from the rear of the door handle arrangement 2. In the region of the cam axis NA, the lever 6 has the slot-shaped cam guide 6.2 in which the ends of the cam carrier 9 are movably mounted and force-guided. For mounting the cam carrier 9 in the region of the cam axis NA, two middle support elements 15.1 comprise semicircular bearing openings 13 for the central mounting of the cam carrier 9 and two outer support elements 15.2 include circular bearing openings 13 for receiving the ends of the cam carrier 9.

The lever 6 also comprises a corresponding web 6.8 for each drive or main cam 9.1. The webs 6.8 each engage with the associated main cam 9.1 for adjusting the handle element 3. Each web 6.8 protrudes inward from the associated lever arm 6.3. Each web 6.8 has an angled end 6.9 along its longitudinal alignment.

Figure 10:
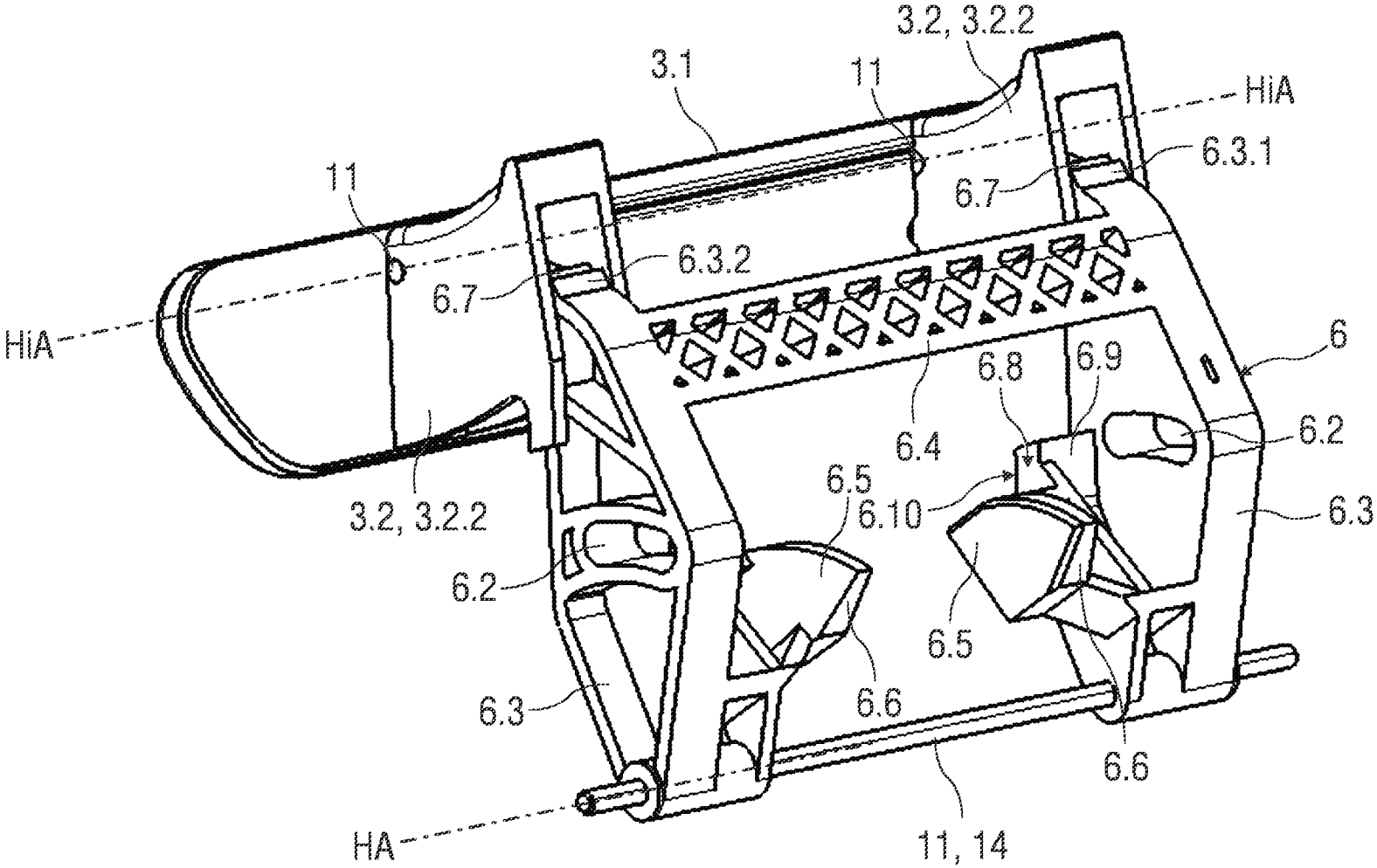
FIG. 10 is a schematic perspective view of a lever arrangement of an adjusting mechanism of the door handle arrangement having a handle element arranged on the lever.

The web 6.8 has a cam counter surface 6.10 corresponding in the direction of the main cam 9.1, as shown in FIG. 10. This cam counter surface 6.10 is formed at the angled end 6.9 and is at a small distance, for example the size of an air gap, to the associated main cam 9.1 in a retracted position of the handle element 3 (non-use position P1). During the adjustment of the handle element 3 into the use position P2, the cam counter surface 6.10 is in engagement with the associated main cam 9.1 and controls the extension movement of the handle element 3 from the non-use position P1 into the use position P2.

Figure 11D:
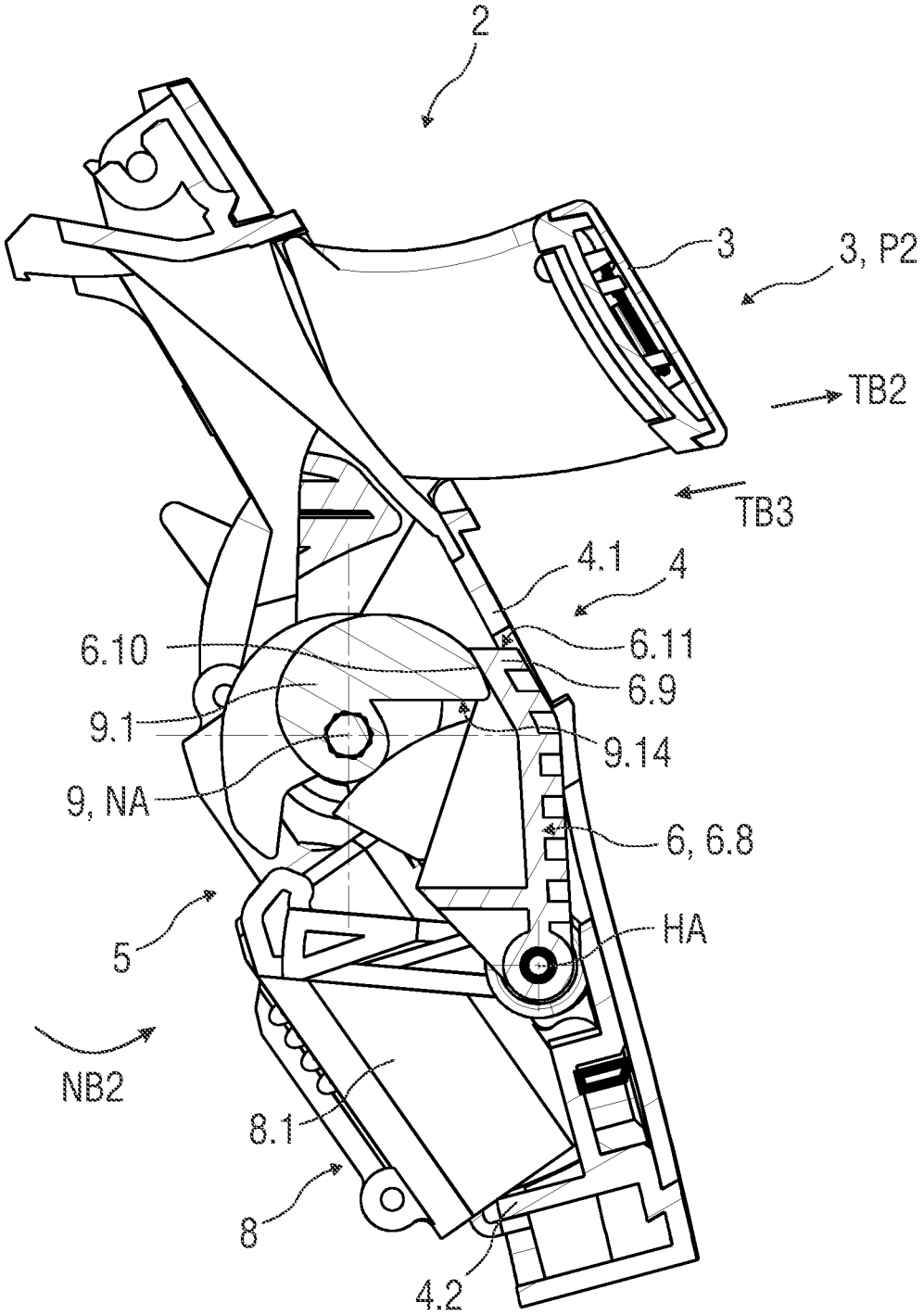

In the extended position (use position P2) the cam counter surface 6.10 and the associated main cam 9.1 are in such engagement with one another that each main cam 9.1 fixes and supports the handle element 3, in particular fixes it in a pretensioned manner (as shown in FIG. 11D).

Conversely, a retraction movement of the handle element 3 from the use position P2 back into the non-use position P1 is controlled exclusively via the auxiliary cam 9.3 and the spring-pretensioned spring carrier 14 with the projection 14.3 thereof, which is in operative engagement therewith.

Figure 18:
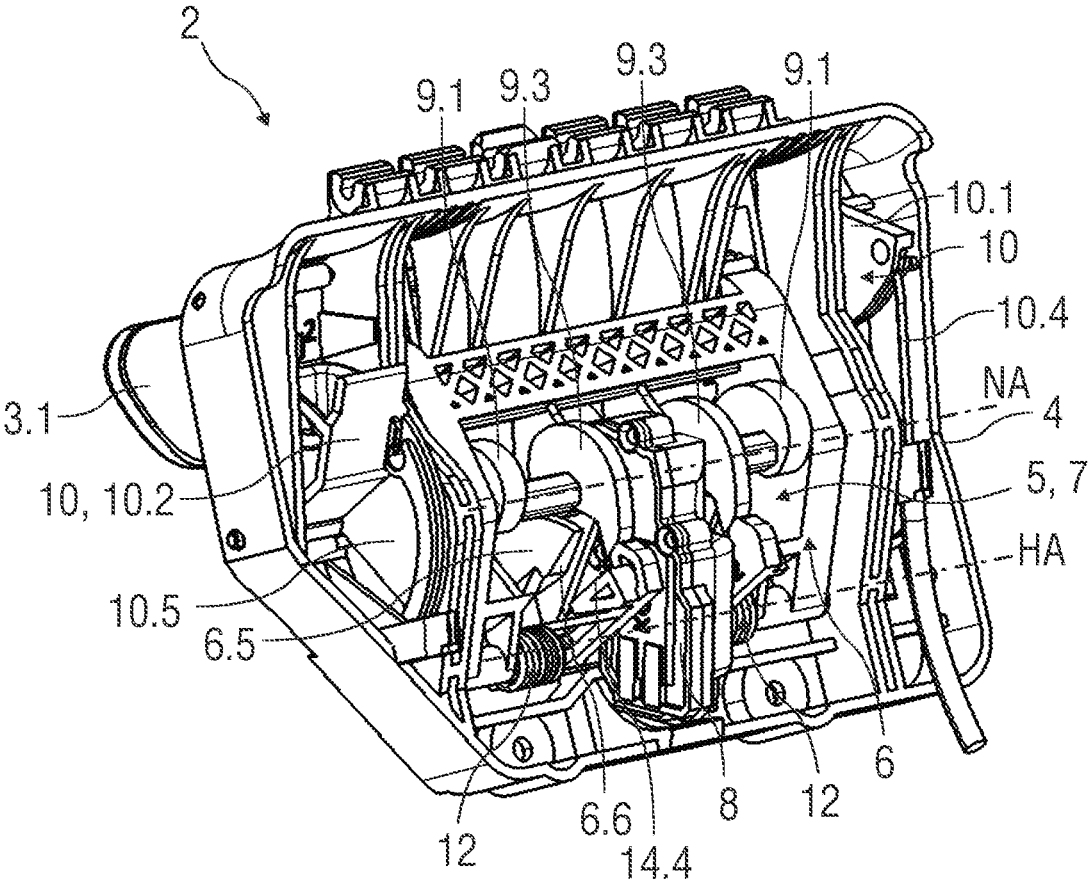
Figure 19:
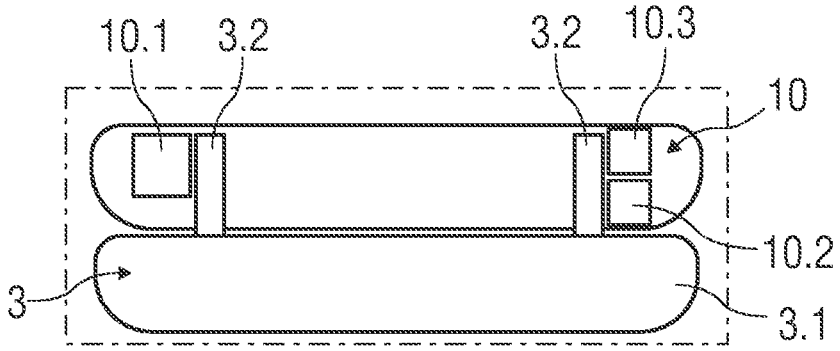

In addition, the lever 6 comprises two central receiving profiles 6.5 for supporting the lever 6 in the retracted state of the handle element 3 and thus in the non-use position P1 on the spring carrier 14 (shown in FIGS. 11 and 18).

FIG. 10 is a schematic perspective view of a lever arrangement having the lever 6 and its lever arms 6.3 of the adjusting mechanism 5 of the door handle arrangement 2 having the handle element 3 arranged on the lever 6. The handle element 3 is movably mounted on the lever 6 by means of the handle carrier 3.5 in the pivot bearing 11 about the secondary axis HiA. The lever 6 is movably mounted about the main axis HA on the pivot bearing 11, which is also designed as a spring carrier 14.

In addition, the lever 6 comprises, between the lever arms 6.3, the receiving profiles 6.5 projecting inward from these lever arms 6.3. The receiving profiles 6.5 have corresponding support surfaces 6.6 in the direction of the spring carrier 14, which are supported on corresponding spring stop surfaces 14.2 in the retracted state of the handle element 3 (in FIGS. 11 and 18).

In addition, the lever arms 6.3 have latching projections 6.3.1 for the latching groove 6.7 of the handle support element 7.1.

FIG. 11 is a schematic perspective view of the adjusting mechanism 5 of an electrically operated door handle arrangement 1 without a lever arrangement having the lever 6 described above.

The adjusting mechanism 5 comprises the drive device 8 with the motor 8.1, the gearbox 8.2, and the housing 8.3. When the motor 8.1 is in operation, the worm shaft 8.4 drives the worm wheel 8.5 and the cam carrier 9 connected thereto, so that they rotate. On the cam carrier 9, two main cams 9.1 and two auxiliary cams 9.3 are arranged.

The main cams 9.1 are used for the controlled movement of the handle element 3 from the non-use position P1 into the use position P2. Each main cam 9.1 is designed, for example, as a disc with a curved or arcuate projection or as a cam disk with a corresponding pitch or a corresponding arcuate projection. To adjust the handle element 3, a rotational movement of the adjusting arrangement 7, in particular the cam carrier 9, and thus a rotational movement of the main cams 9.1 about the cam axis NA is converted into a translational movement, in particular into a translational extension or retraction movement, of the handle element 3. Each curved or arcuate projection of the main cams 9.1 has, for example, a variable pitch. As a result, the door handle arrangement 2 is set up to absorb mechanical forces greater than 250 N when the handle element 3 is actuated, as can occur, for example, when a frozen door handle is opened. In addition, the projection of each main cam 9.1, which main cams are symmetrical, is designed such that the main cams 9.1 are positioned against the rear side of the handle surface 3.1 of the handle element 3 in the end position of the handle element 3 in the use position P2 (shown in dashed lines), so that they fix the handle element 3 and support it, in particular block it or optionally fix it in a pretensioned manner.

For this purpose, the spring carrier 14 comprises projections 14.3 in the direction of the auxiliary cams 9.3, which abut against the auxiliary cams 9.3 in the use position P2 and block the auxiliary cams 9.3.

In addition, the adjusting mechanism 5 can comprise auxiliary cams 9.3 for spring decoupling of a return spring arrangement for the handle element 3. The spring arrangement, in particular the return spring 12, is arranged on the spring carrier 14 in the region of the main axis HA. A spring end 12.1 on the cam side is fixed on the cam carrier 9. An opposite spring end 12.2 is fixed on the spring carrier 14.

The spring carrier 14 is also designed as a hollow profile and has a through opening 14.1 in which the pivot bearing 11 of the main axis HA is received, as shown in FIG. 5 or 18, for example.

By means of such an adjusting arrangement 7 having auxiliary cams 9.3 for spring decoupling, the drive device 8, in particular the motor 8.1, can be made smaller.

In addition, an electronic actuator 18, for example Hall sensors, can be provided for controlling the motor 8.1 for a controlled, in particular position-dependent, extension of the handle element 3.

FIGS. 11A and 11C to 11D show a schematic sectional view of a further embodiment for a door handle arrangement 2 having a cam control for different positions of the handle element 3, in particular in the region of the adjusting mechanism 5 with different positions P1 to P3 of the handle element 3. One or at least two main cams 9.1 is or are arranged on the cam carrier 9.

FIG. 11B shows an embodiment of a main cam 9.1 in detail with its cam portions 9.11 to 9.13 with variable pitch curves.

The door handle arrangement 2 comprises a carrier element 4, for example as described above with reference to FIGS. 1 to 11. The door handle arrangement 2 also comprises a handle element 3 which is arranged on the carrier element 4 so as to be movable between a non-use position P1 and a use position P2, as has been described, for example, with reference to FIGS. 1 to 11.

The adjusting mechanism 5 for adjusting the handle element 3 relative to the carrier element 4 is described in detail below.

The adjusting mechanism 5 comprises the lever 6 and the cam carrier 9 with at least one main cam 9.1 for the controlled movement of the handle element 3 between the non-use position P1 and the use position P2.

The main cam 9.1 interacts with the cam counter surface 6.10 arranged on the lever 6. For this purpose, the main cam 9.1 has a variable curve shape, in particular a variable cam pitch or a variable projection profile. A rotation NB of the main cam 9.1 as a result of the drive by the motor 8.1 causes the cam counter surface 6.10 to be actuated and the lever 6 to be pivoted accordingly according to the rotational movement DB in order to extend or retract the handle element 3 according to the translational movement TB. The cam carrier 9 is coupled in terms of movement to the motor 8.1 and is driven by the motor 8.1.

For example, each main cam 9.1 has three cam portions 9.11 to 9.13 with different curve shapes, in particular pitches. The three cam portions 9.11 to 9.13 cause different adjustment strokes of the handle element 3, as described below.

A first cam portion 9.11 has a smaller pitch than a second cam portion 9.12. A pitch is understood to mean the increase in the cam radius r per angle of rotation. A third cam portion 9.13 has a substantially constant pitch. In other words: The third cam portion 9.13 has an approximately equal cam radius per angle of rotation of the cam. The third cam portion 9.13 is used to lock or block the handle element 3 in the extended position (use position P2) on the neutral radius of the third cam portion 9.13.

In one possible embodiment, the first cam portion 9.11 has a first curve shape, in particular a first pitch curve, the main cam 9.1 and the lever 6 being slightly spaced apart from one another in the non-use position P1, as shown in FIG. 11A. When moving out of the non-use position P1, the main cam 9.1 and the lever 6, in particular its cam counter surface 6.10, come into engagement with one another to control the extension movement of the handle element 3.

This first cam portion 9.11, in particular this first curve shape, is designed such that the force required to release the handle element 3 can be overcome when the main cam 9.1 moves a first rotational movement NB1, in particular is pivoted, as shown for example in FIG. 11C.

In addition, the first curve shape can be designed such that, in addition to overcoming the force, the force required to release a frozen handle element 3 is overcome. Due to the small pitch, a great force can be applied. In addition, the main cam 9.1 can have a cam offset 9.14, which serves as an end stop. In the non-use position P1 of the handle element 3, an end face 6.11 of the lever 6, in particular the angled end 6.9, abuts against the cam offset 9.14.

For this purpose, the first cam portion 9.11 has, for example, a particularly low pitch. For example, the cam radius r doubles over an angle of rotation of 180° of the main cam 9 in the first cam portion 9.11.

The first cam portion 9.11 is designed in particular, in particular is provided with such a projection profile or such a curve shape, that rotating the main cam 9.1 in the opening direction NB1 in a first rotational angle range of 160° to 200°, in particular by 180°, causes a first opening movement TB1 of the handle element 3 in an adjustment range of 4 mm to 7 mm, in particular of 5.5 mm, as shown with reference to the sequence of FIGS. 11A and 11C.

In a further embodiment, the second cam portion 9.12 has such a curve shape, in particular a steep pitch, that the main cam 9.1 and the lever 6 can be moved relative to one another in order to move the handle element 3 from the intermediate position P3 to the use position P2. As already described above, the retraction movement of the handle element 3 is controlled accordingly by the engagement of the projection 14.3 of the spring carrier 14 and the auxiliary cams 9.3.

For example, the cam radius r triples or quadruples over an angle of rotation of 180° of the main cam 9.1 in the second cam portion 9.12. The second cam portion 9.12 can be designed, for example, such that a rotation or pivoting of the main cam 9.1 according to a second rotational movement NB2 in a second rotational angle range of 160° to 200°, in particular by 180°, causes a second opening movement TB2 of the handle element 3 in a range of 25 mm to 30 mm, in particular 27.5 mm, as shown by virtue of the sequence of FIGS. 11C and 11D.

The third cam portion 9.13 has, in particular, a largely constant or very small pitch, so that the main cam 9.1 and the lever 6 come into a blocking or locking engagement in the use position P2. In order to get out of this blocking or locking engagement when the handle element 3 is adjusted back into the intermediate position P3 or the non-use position P1, the auxiliary cams 9.3 are in engagement with the projections 14.3 of the spring carrier 14.

This third cam portion 9.13 comes into a blocking or locking engagement, in particular a frictional engagement, with the cam counter surface 6.10 on the lever 6 when the handle element 3 is placed in the use position P2. This third cam portion 9.13 is designed such that a force required to release the engagement, even for example with an at least slightly frozen handle element 3, can be overcome when the main cam 9.1 is moved in the closing direction TB3. Depending on the type and design of the drive, in particular in the case of a motor 8.1, the cam portion 9.13 can be designed such that the handle element 3 cannot be pushed into the intermediate position P3 or the non-use position P1 by hand.

Another aspect provides that the cam carrier 9 comprises a plurality of main cams 9.1, which are designed to correspond to one another.

Figure 12:
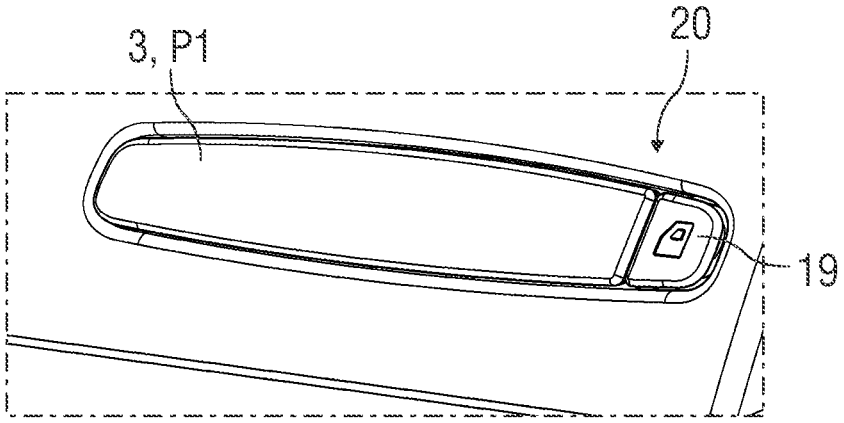
FIGS. 12 and 13 are schematic views of a manually operable door handle arrangement with different positions of the handle element.
Figure 13:
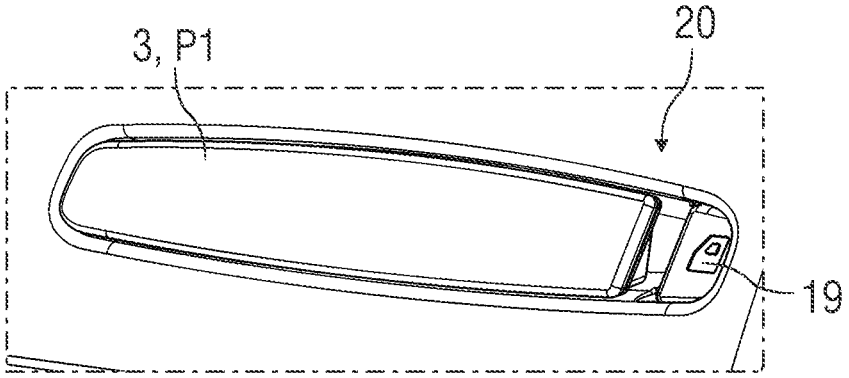

FIGS. 12 and 13 show schematic views of a manually operable door handle arrangement 20 with different positions of the handle element 3. Instead of the drive device 8, the door handle arrangement 20 comprises a manual switching element 19, for example a slide or a push switch (also called a push element). When the switching element 19 is actuated, the handle element 3 is moved from the non-use position P1 into the use position P2 due to a movement coupling of the switching element 19 with the adjusting arrangement 7, in particular the main cam 9.1.

Figure 14:
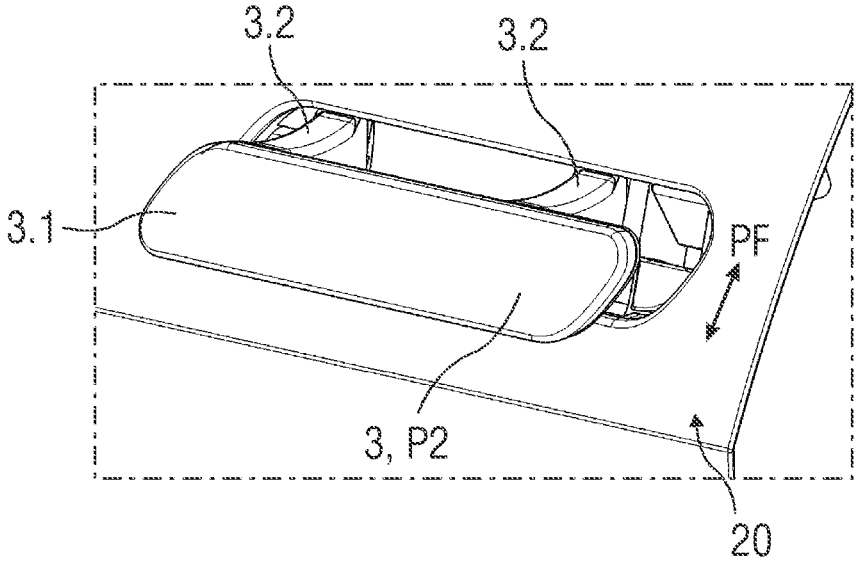
FIGS. 14 to 19 are schematic views of a door handle arrangement having optional functional units.
Figure 15:
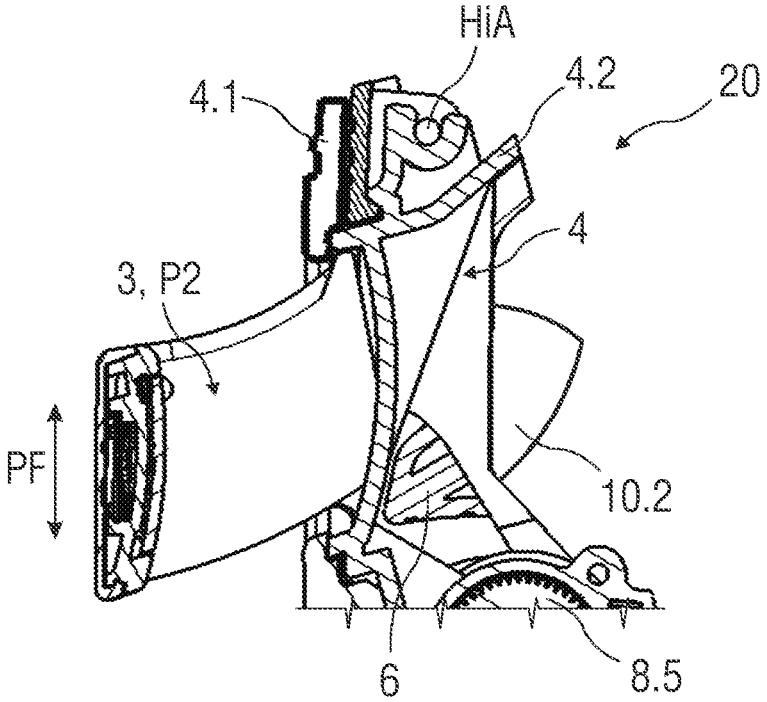

FIGS. 14 and 15 show the manually operable door handle arrangement 20 in the extended use position P2. To trigger or open the door lock (not shown in detail), the extended handle element 3 can then additionally be moved, for example by means of a vertical movement according to arrow PF.

FIGS. 16 to 19 show schematic views of a door handle arrangement 2 having an optional functional unit which is designed as a mechanical emergency actuation unit 10.

The emergency actuation unit 10 comprises one or more manual actuation elements 10.1, 10.2.

A front actuation element 10.1 rotates when under pressure and thereby actuates, for example, a Bowden cable 10.4 for emergency unlocking and opening. A rear actuation element 10.2 is designed in the manner of a drawer, the engagement of which is covered by a flap 10.3. For example, if a user presses the flap 10.3 by using one finger, the drawer can then be pulled with this finger (also a rotational and/or linear movement), whereby the Bowden cable 10.4 is actuated for emergency unlocking and the flap 10.3 is closed again.

The actuation element 10.2 can also be coupled to a coupling element 10.5, which in turn is coupled for movement with the cam carrier 9, so that when the actuation element 10.2 is actuated by a user, the cam carrier 9 is moved and the handle 3 is manually operated.

LIST OF REFERENCE SIGNS

1 Vehicle door
1.1 Inside of the door
1.2 Opening
1.3 Outside of the door
2, 20 Door handle arrangement
3 Handle element
3.1 Outer handle surface
3.2 Handle bar
3.2.1 Sliding element
3.2.2 Handle bar arms
3.2.3 Stop
3.3 Handle recess
3.4 End stop on the handle side
3.5 Handle carrier
3.6 Handle electronics
4 Carrier element
4.1 First carrier part
4.1.1 Handle opening
4.2 Second carrier part
4.2.1 Base element
4.2.2 Edge
4.3 Handle guide
4.4 End stop on the carrier side
5 Adjusting mechanism
6 Lever
6.1 Projection
6.1.1 Handle stop surface
6.2 Cam guide
6.3 Lever arms
6.3.1 Locking projection
6.4 Transverse profile
6.5 Receiving profile
6.6 Support surface
6.7 Latching groove
6.8 Web
6.9 Angled end
6.10 Cam counter surface
6.11 End face
7 Adjusting arrangement
7.1 Handle support element
8 Drive device
8.1 Motor
8.2 Gearbox
8.3 Housing
8.4 Worm shaft
8.5 Worm wheel
8.6 Screw connection
8.7 Locking connection
9 Cam carrier
9.1 Main cam
9.2 Axial securing means
9.3 Auxiliary cam
9.11, 9.12, 9.13 Cam portion
9.14 Cam offset
10 Emergency actuation unit
10.1, 10.2 Actuation element
10.3 Flap
10.4 Bowden cable
10.5 Coupling element
11 Pivot bearing
12 Return spring
12.1, 12.2 Spring end
13 Bearing opening
14 Spring carrier
14.1 Through opening
14.2 Spring stop surface
14.3 Projection
15 Support element
15.1 Middle support element
15.2 Outer support element
16 Stiffening element
17 Fastening element
18 Actuator electronics
19 Switching element
DB Rotational movement
FR Free space
HA Main axis
HiA Secondary axis
NA Cam axis
NB Rotation
NB1 First rotational movement
NB2 Second rotational movement
PF Arrow
P1 Non-use position
P2 Use position
P3 Intermediate position
r Cam radius
TB Translational movement
TB1 First opening movement
TB2 Second opening movement
TB3 Closing direction

The invention claimed is:

1. A door handle arrangement, comprising:

a carrier element, a handle element which is movably arranged on the carrier element between a non-use position and a use position, and an adjusting mechanism for adjusting the handle element relative to the carrier element, wherein the adjusting mechanism comprises a lever mechanism having a first single-arm lever and a second single-arm lever and a cam carrier having at least one main cam in each arm for the controlled movement of the handle element between the non-use position and the use position, and wherein each main cam interacts with a respective cam counter surface arranged on the first single-arm lever and the second single-arm lever and has a variable curve shape, wherein each single-arm lever comprises a respective cam guide formed therein, and wherein the adjusting mechanism comprises at least two axes;

where a first axis is a cam axis of the cam carrier which carries a first main cam for the first single-arm lever and a second main cam for the second single-arm lever, and wherein a second axis is a pivoting axis of the first single-arm lever and the second single-arm lever, wherein the cam carrier is formed as a drive shaft of a motor arranged between the first main cam and the second main cam and rotatably supported in the first single-arm lever and the second single-arm lever and driven by the motor which is arranged perpendicular to the first axis and the second axis.

2. The door handle arrangement according to claim 1, wherein the main cam has at least first and second cam portions with different curve shapes.

3. The door handle arrangement according to claim 2, wherein the first cam portion has a first curve shape that the main cam and the lever are arranged to be spaced apart from one another in the non-use position.

4. The door handle arrangement according to claim 2, wherein the second cam portion has a second curve shape that the main cam and the lever can be moved relative to one another in order to move the handle element in an intermediate position or the use position.

5. The door handle arrangement according to claim 2, wherein the first cam portion is designed such that a rotation of the main cam according to a first rotational movement in a first rotational angle range of 160° to 200° causes a first opening movement of the handle element in a range of 4 mm to 7 mm.

6. The door handle arrangement according to claim 2, wherein the second cam portion is designed such that a rotation of the main cam according to a second rotational movement in a second rotational angle range of 160° to 200° causes a second opening movement of the handle element in a range of 25 mm to 30 mm.

7. The door handle arrangement according to claim 1, wherein the at least one main cam is designed as a disc or roller.

8. The door handle arrangement according to claim 1, wherein the adjusting mechanism and the handle element and the carrier element are in operative connection with one another in the use position of the handle element such that the handle element is fixed in the use position.

9. The door handle arrangement according to claim 1, wherein the adjusting mechanism comprises at least one adjusting arrangement through which the handle element is fixed under tension at least in the use position.

10. The door handle arrangement according to claim 1 wherein the adjusting mechanism comprises a main axis about which the lever is mounted on the carrier element and the lever is movably mounted relative to the carrier.

11. The door handle arrangement according to claim 1, wherein the cam carrier comprises at least one auxiliary cam arranged thereon for spring decoupling.

12. The door handle arrangement according to claim 1, wherein the cam carrier is guided in each cam guide when the handle element is adjusted between the non-use position and the use position.

13. The door handle arrangement according to claim 1, wherein the carrier element comprises at least one handle guide, in or on which the handle element is guided when it is adjusted between the non-use position and the use position.

14. A vehicle door having at least one door handle arrangement according to claim 1.

15. The door handle arrangement according to claim 1, wherein the arms have an upper portion and a lower portion, wherein the profile extends between the upper portions and the pivot bearing extends between the lower portions.

16. The door handle arrangement according to claim 1, wherein an upper portion of each arm is selectively biased by respective handle support elements each housed in a respective handle bar.

17. A door handle arrangement, comprising:

a carrier element, a handle element which is movably arranged on the carrier element between a non-use position and a use position, and an adjusting mechanism for adjusting the handle element relative to the carrier element, wherein the adjusting mechanism comprises a lever mechanism having a first single-arm lever and a second single-arm lever and a cam carrier having at least one main cam in each arm for the controlled movement of the handle element between the non-use position and the use position, and wherein each main cam interacts with a respective cam counter surface arranged on the first single-arm lever and the second single-arm lever and has a variable curve shape, wherein each single-arm lever comprises a respective cam guide formed therein, and wherein the adjusting mechanism comprises at least two axes;

where a first axis is a cam axis of the cam carrier which carries a first main cam for the first single-arm lever and a second main cam for the second single-arm lever, and wherein a second axis is a pivoting axis of the first single-arm lever and the second single-arm lever, wherein the cam carrier is formed as a drive shaft of a motor rotatably supported in the first single-arm lever and the second single-arm lever with respect to the carrier element around the cam axis and pivotably supported by the cam guide formed in the first single-arm lever and the second single-arm lever with respect to the first single-arm lever and the second single-arm lever around the pivoting axis.

* * * * *